US007810368B2

(12) United States Patent
Rusch

(10) Patent No.: US 7,810,368 B2
(45) Date of Patent: Oct. 12, 2010

(54) MULTI-MODE HAMMERING MACHINE

(76) Inventor: Christopher J. Rusch, 3718 Riverview Dr., Two Rivers, WI (US) 54241

( * ) Notice: Subject to any disclaimer, the term of this patent is extended or adjusted under 35 U.S.C. 154(b) by 211 days.

(21) Appl. No.: 12/217,537

(22) Filed: Jul. 7, 2008

(65) Prior Publication Data

US 2010/0000287 A1 Jan. 7, 2010

(51) Int. Cl.
*B21J 13/00* (2006.01)

(52) U.S. Cl. ..... 72/450; 72/375; 72/441; 72/446; 72/448; 72/472; 72/481.1

(58) Field of Classification Search ..... 72/435, 72/440, 441, 446, 448, 450, 451, 453.07, 72/472, 481.1
See application file for complete search history.

(56) References Cited

U.S. PATENT DOCUMENTS

| | | | | |
|---|---|---|---|---|
| 1,458,667 | A * | 6/1923 | Sustarich | 72/446 |
| 1,485,486 | A * | 3/1924 | Depew | 72/481.6 |
| 1,524,195 | A * | 1/1925 | Massey | 72/441 |
| 7,331,207 | B2 | 2/2008 | Borgwarth | 72/448 |

OTHER PUBLICATIONS

Industrial Press, Inc. Book entitled "Ingenious Mechanism for Designers and Inventors—vol. III, 1951, article entitled Variable-Stroke Mechanism for Toggle Lever Press.", pp. 227-229.

Dake website printout of "Power Hammer" machine brochure believed published prior to 2006.

Yoder K90 and LK90 Power Hammers metal forming machine brochures believed published prior to 2006.

Pullmax P2, P9, P13, P21 and P201 universal plate cutting and working machine brochures believed published prior to 2006.

Eckhold Kraftformer website printout of "Three machines in one" MultiFormer MF 500 and MF 800 metal shaping, HF 100 hand former and GL 2 planishing hammer machines believed published prior to 2006.

* cited by examiner

*Primary Examiner*—David B Jones
(74) *Attorney, Agent, or Firm*—Jeffrey S. Sokol

(57) ABSTRACT

The invention is a multi-mode hammering machine that operates in a rigid mode, a flexible power hammer mode and a machine press mode to contour, shape and form sheet metal products. In all three modes, a ram is linearly stroked toward and away from a fixed die by a common ram drive assembly that includes a lever drive assembly and a reciprocating lever. The lever drive assembly moves in a rigid non-flexing manner. The reciprocating lever includes a rigid mode and a flexible mode. A conversion pin is used to engage one and simultaneously disengage the other. The lever drive assembly includes a control link that interfaces with a stroke adjustment mechanism. The gap adjustment mechanism is located at the fulcrum of the reciprocating lever. Both stroke length and gap are adjusted independently during the operation while the ram is cycling.

22 Claims, 12 Drawing Sheets

FIG. 5A
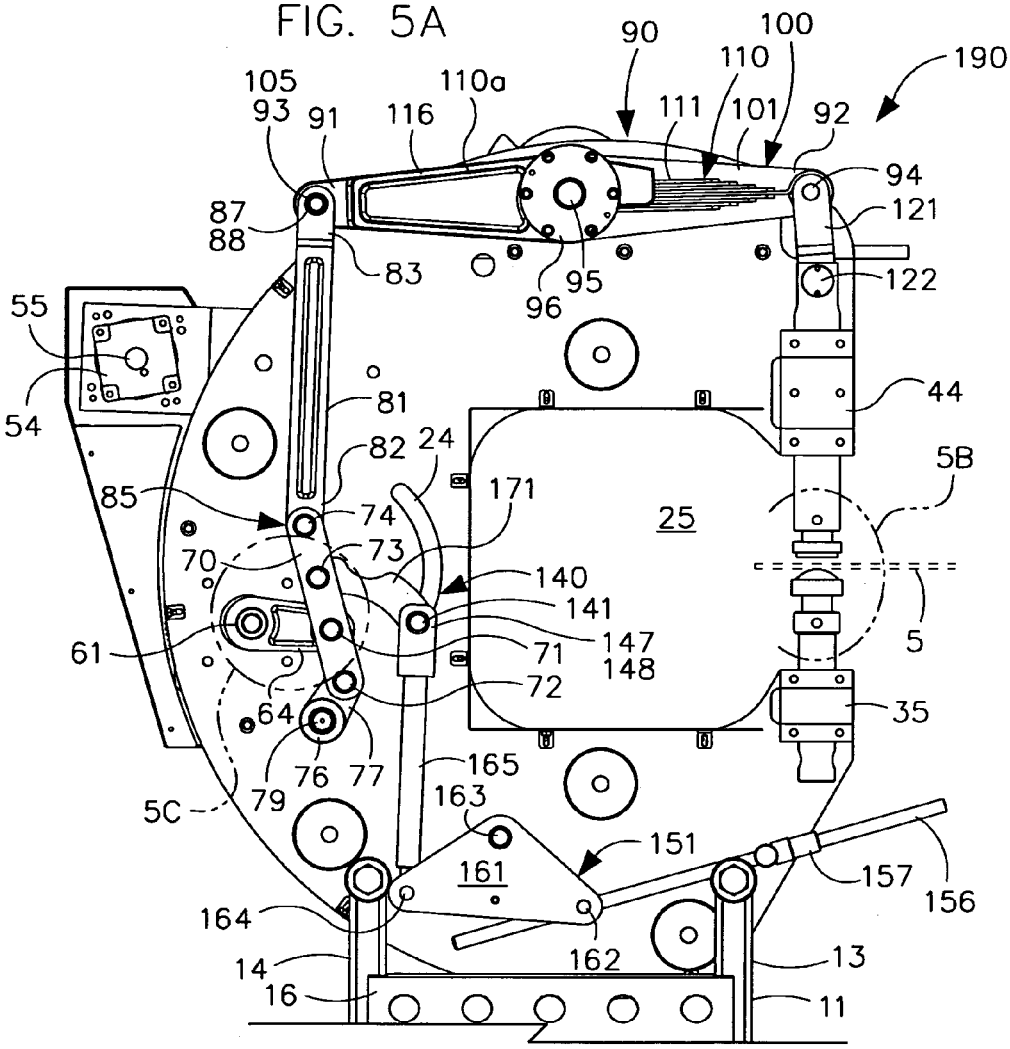
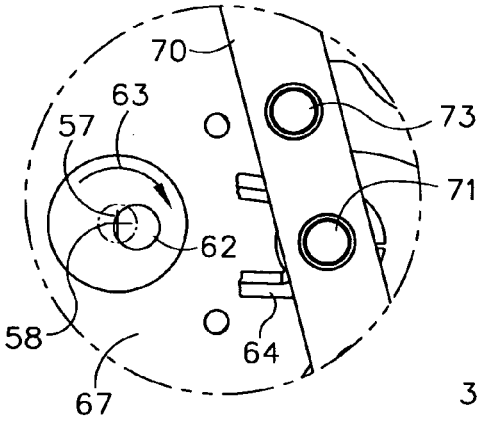
FIG. 5C
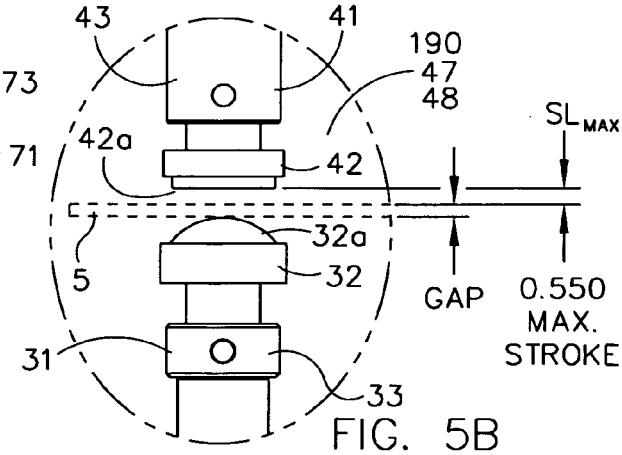
FIG. 5B

FIG. 6A
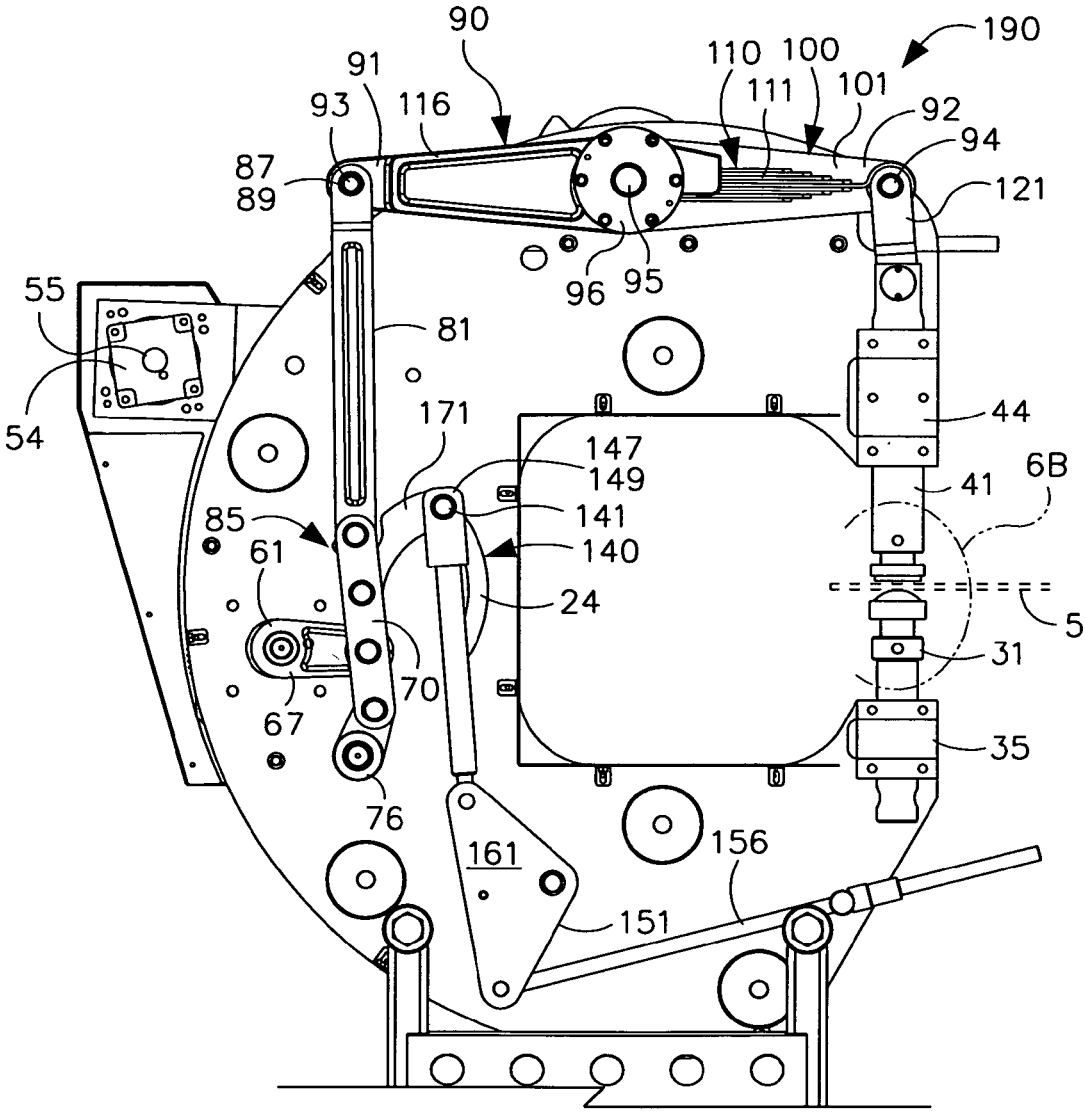
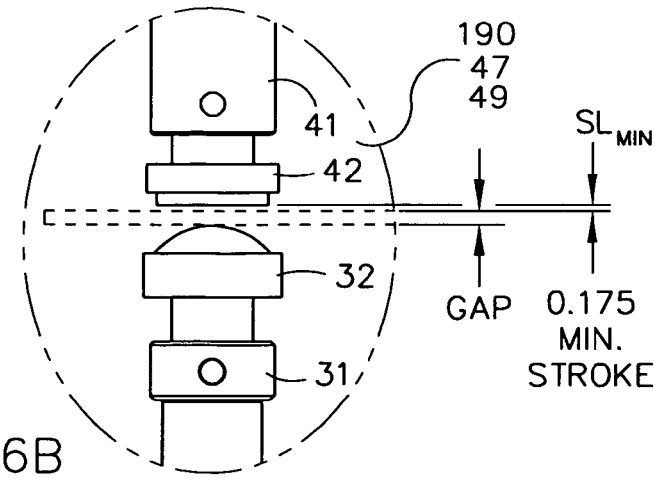
FIG. 6B

FIG. 7A
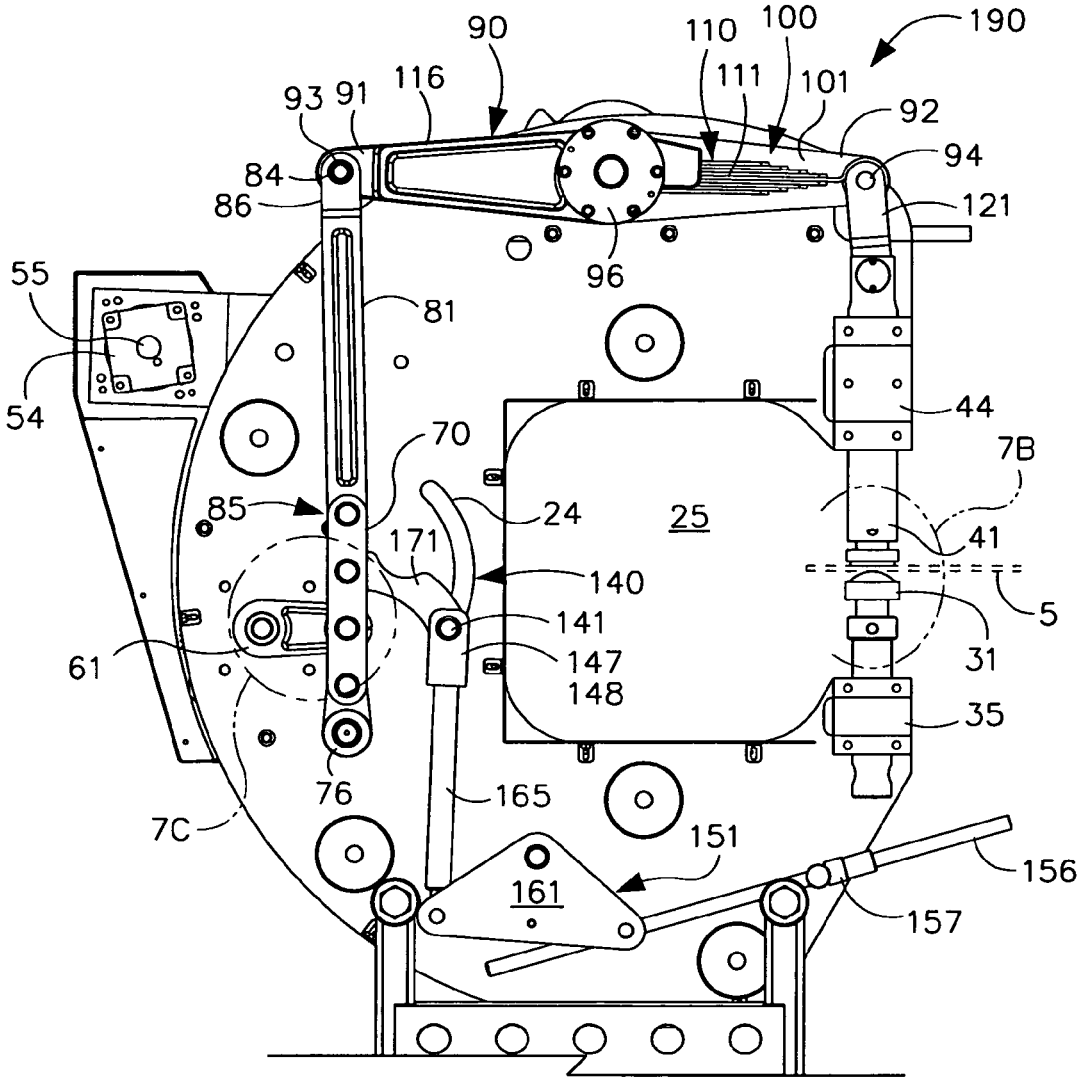
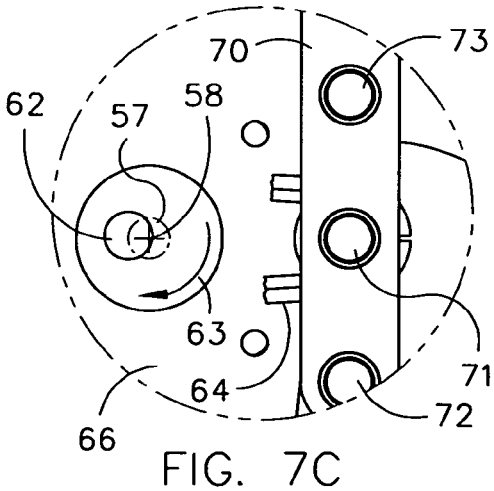
FIG. 7C
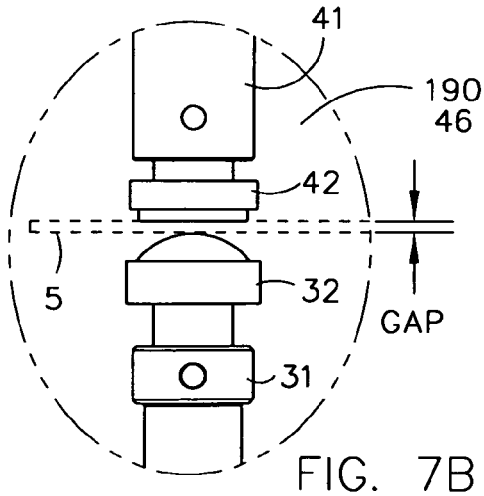
FIG. 7B

FIG. 8A
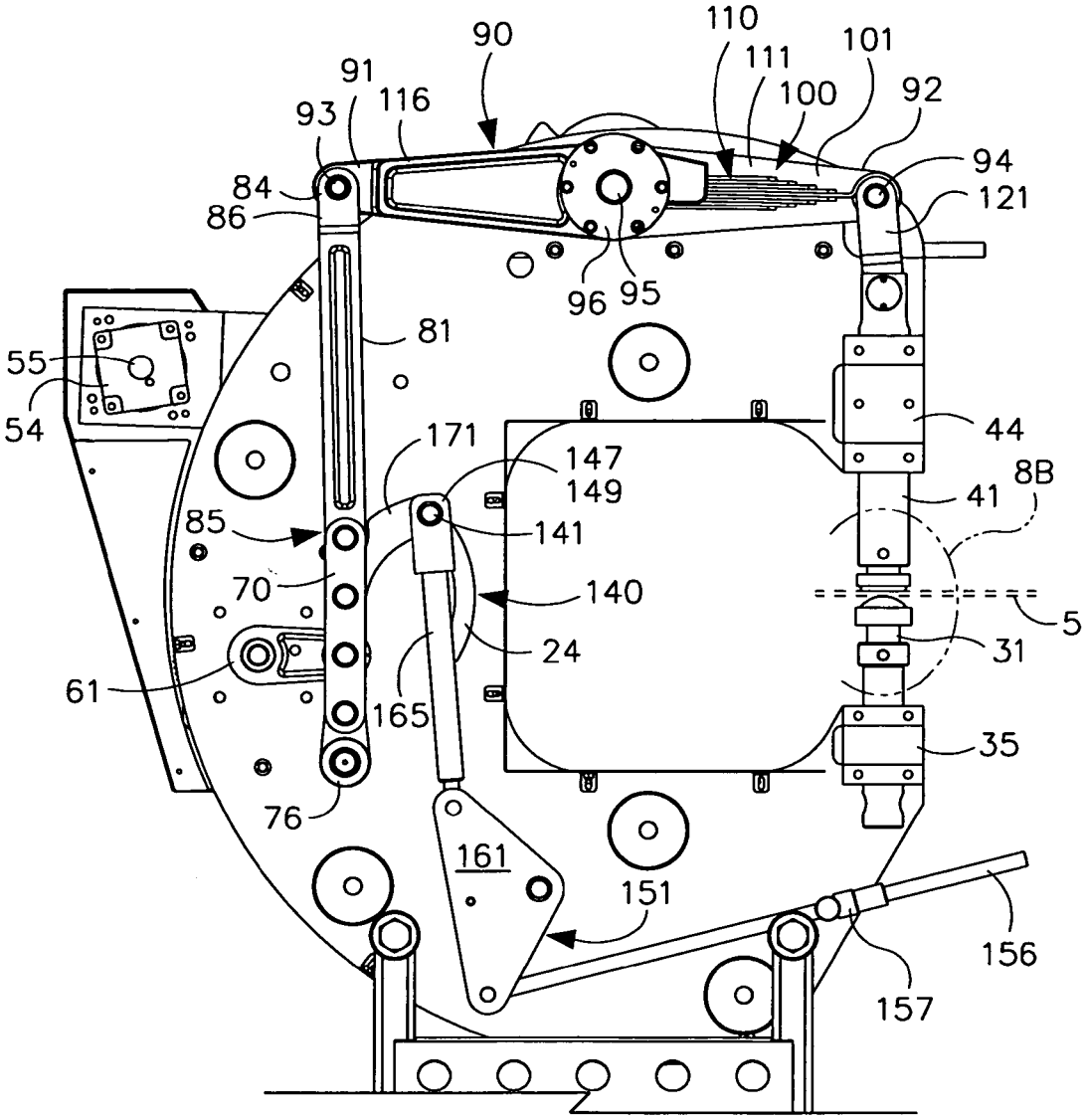
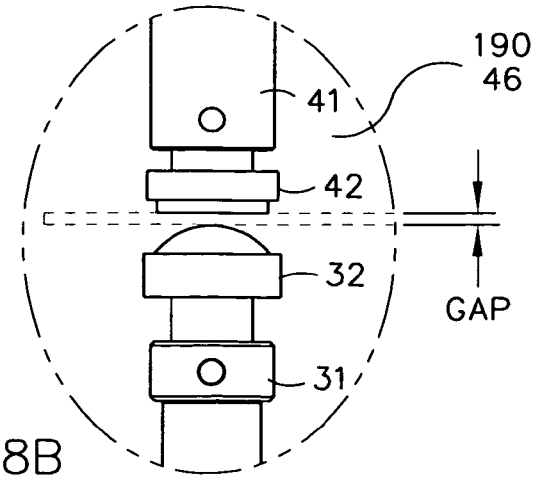
FIG. 8B

MULTI-MODE HAMMERING MACHINE

TECHNICAL FIELD OF THE INVENTION

This invention relates to a hammering machine for shaping sheet metal that operates in a rigid-stroke mode, a flexible-stroke hammering mode, and a rigid-stroke machine press mode, and where the ram stroke length and tool gap adjustment mechanisms are independently adjustable during operation.

BACKGROUND OF THE INVENTION

Sheet metal shaping, hammering and pressing machines are well known. These machines typically have a fixed die and a ram that moves toward and away from the die. A metal sheet is placed on the die and the ram is lowered to shape, hammer or press the workpiece. Shaping machines have contoured male and female tools fixed to the die and ram that cause the sheet to take the shape of the tools, but do not compress or hammer the sheet metal. The tools are kept apart a distance or gap equal to the thickness of the sheet metal workpiece. The sheet metal takes on a curved or other desired shape dictated by of the ram and die tools. Hammering machines use the ram to strike the sheet metal with enough force to cause the metal to flow and compress or thin the workpiece. Hundreds of hammer strikes are often needed to properly shape the metal to the desired thickness and shape. A press typically performs a specific task in various localized areas on the workpiece, such as forming holes, notches, slots, crimps or the like into the workpiece. Metal forming machines help alleviate the more strenuous and repetitious shaping, hammering and forming work needed to fabricate various sheet metal products. These machines also increase the consistency of the forces being applied, and free up the hands of the operator so that he or she can better position the workpiece between the ram and die to more accurately and quickly shape the workpiece.

Shaping machines use a rigid ram stroke to contour the workpiece. The drive mechanism raises the ram to a first position above the die tool, and then extends or lowers the ram toward the die to a second position. The ram stroke is set to a desired length, and the ram rigidly moves back and forth between the raised and lowered positions during each stroke or beat of the machine. Conventional machines can cycle the ram about 1,000 beats per minute (bpm). The machine allows the operator to set the gap between the die and the lower most position of the ram. The gap is typically set to the thickness of the material before operating the machine. Adjustments to the gap are not made during the operation of the machine. The motor and rigid stroke drive system are not typically strong enough to compress and reduce the thickness of the metal workpiece. An example of this type of rigid stroke machine is the P5 machine produced by Pullmax of Sweden.

Hammering machines use a flexible ram stroke to produce the power or force needed to get the metal to flow in the sheet metal, and when desired, compress or reduce the thickness of the sheet. Again, the drive mechanism raises the ram to a first position above the die tool, and then extends or lowers the ram toward the die to a second position. Although the ram stroke is set to a desired length, the ram drive has a flexible component that allows a degree of play in the ram stroke length during each beat of the machine. The first stroke of the machine does not necessarily produce all the metal flow or entirely compress the sheet of metal. The ram acts more like a hand held hammer and consecutively drives down the sheet metal. While the first stroke may do the majority of the compression, several subsequent strokes can add to that compression. The flexible drive does not necessarily crush the sheet metal to the set gap thickness after the first stroke. The ram stroke and crushing of the metal can actually exceed the gap setting particularly after several strokes of the ram. Thickness is determined by how many hammer beats a particular area of the sheet metal receives. The flexing components in the machine produce a whipping action that can accentuate the power of the machine and the ram impact forces produced by the machine. Again, the ram can be cycled about 1,000 bpm. The faster the machine operates, the more the flexible component of the ram drive flex. When the operator sets the stroke length, machine speed and flexible action of the ram drive with the springiness of the material, a harmonic effect can occur that increases the ram impact forces produced by the machine. Yet, conventional machines do not allow stroke length and gap adjustments during the operation of the machine. An example of this type of power enhancing machine is the LK90 machine produced by Yoder of Cincinnati Ohio.

Flexible stroke hammering machines give the operator more control over the shape and thickness of the workpiece being shaped. More or less contouring can be generated by more or fewer repeated beats on the same area of the workpiece. Thicker or tougher pieces of metal can be worked by the machine without resetting the gap and stroke length. This type of power hammering machine is particularly suited for making prototypes or custom made parts, such as car and motorcycle body parts. These machines are also known to produce extra impact power given the motor and stroke length of the machine.

A machine press uses the ram and die in conjunction with specifically contoured surfaces to form the metal workpiece into a specific shape or punch a hole or depression into a portion of the workpiece. The press typically strikes a sheet metal part only a single time to perform a specific task. A reciprocating drive mechanism is typically not necessary or desired. Instead, presses typically include a relatively less expensive hand operated drive mechanism with levered mechanical advantage to produce the force needed to work the sheet material.

A problem in the metal forming industry is meeting customer demands to perform a wide variety of metal forming jobs. Because customers and metal forming shops have a wide variety of metal forming needs, each shops must have equipment capable of perform a wide variety of jobs. To meet these demands, shops need ready access to a wide variety of metal forming machines. Because each machine typically performs a specific function different from other machines, each shop must purchase and provide floor space for each machine. Yet, metal forming machines are typically quite expensive. To make matters worse, many customer job orders only require the use of one or two machines. While one machine is being used for a specific type of job, other machines sit idle. In addition, a single shop often needs to two or more of each machine to meet order schedules and work flow requirements, and have a back up when one machine goes down unexpectedly or is out of service for scheduled maintenance.

Combining different metal forming machines is either structurally difficult or commercially impossible. Each machine has a drive mechanism suited for a specific job. The structures of the drive mechanisms are not readily combined, and are not readily switched from one mode of operation to another. Integrating the power systems, drive mechanisms, frame housings and tool movements so a single machine can perform a variety of functions is a significant engineering challenge and usually commercially impossible. This is particularly so for different types of shaping, hammering and press machines with different power systems, ram drive mechanisms and stroke length and gap adjusting mechanisms. Rigid reciprocal drives, power enhancing drives with flexible components and mechanically levered hand operated drives are structurally different mechanisms. Each lacks some components of the other and requires other structurally components not found in the others. As a result, metal forming shops have had to incur the expense of buying and allocating floor space for various shaping, hammering and press machines, or endure the consequences of failing to meet customer expectations.

Another problem with combining rigid reciprocating, flexible power enhancing and press machines is that their drive mechanisms must interface with both a mechanism for adjusting the ram stroke length and a mechanism for adjusting the gap between the ram and die. These stroke length and gap adjustment mechanisms should operate independently of each other and during the operation of the machine. As noted above, this is particularly important for hammering machines to allow the operator to achieve increased ram impact forces.

A further problem with combining rigid reciprocating and flexible power enhancing metal forming machines is that the stroke length and gap should be structures so that each can be adjusted on-the-fly or during the operation of the machine. Again, this is particularly important for hammering machines because the operator must be able to adjust stroke length to find the natural harmonic between the stroke length and the material being shaped. The ram forces produced by the natural harmonic can also require gap adjustment so that the sheet metal maintains a desired thickness.

A still further problem with combining rigid reciprocating and flexible power enhancing metal forming machines is that the forces involved are significant. The orientation of the components during moments of particularly high loading must be arranged so that the components are not over stressed. If this is not done, the components will be prone to brake or accelerated wear and tear, which will increase service costs and short the life of the machine.

A still further problem with combining rigid reciprocating and flexible power enhancing metal forming machines is the shape of the machines. To accommodate and work on projects that require large pieces of sheet metal or extremely curved products, the machines must have a large internal cavity. The larger the internal open area for accommodating a large workpiece, the better the machine will be able to handle such projects. The various drive mechanisms and stroke and gap adjustment mechanisms must extend around the internal work cavity.

The present invention is intended to solve these and other problems.

BRIEF DESCRIPTION OF THE INVENTION

The present invention pertains to a multi-mode hammering machine that operates in a rigid metal shaping mode, a flexible power hammer mode and a machine press mode to form sheet metal products. In all three modes, a ram is linearly stroked toward and away from a fixed die. All three modes use a ram drive assembly with a lever drive assembly and a reciprocating lever to cycle the ram up and down. The lever drive assembly moves in a rigid non-flexing manner. The reciprocating lever includes a rigid mode and a flexible mode. A conversion pin is used to engage one and simultaneously disengage the other. The lever drive assembly includes a control link that interfaces with a stroke adjustment mechanism. The gap adjustment mechanism is located at the fulcrum of the reciprocating lever. Both stroke length and gap are adjusted independently during the operation while the ram is cycling.

An advantage of the present multi-mode hammering machine is that it is three machines in one. The single machine is structured to readily perform three different and distinct metal forming functions that are widely used in the sheet metal forming industry. This three-in-one structure allows a plant to significantly reduce its overhead by reducing both machine costs and floor space requirements. Savings are further multiplied by the fact that a single extra machine provides overflow and back up for all three functions. A plant using the machine can more easily and cost effectively meet order schedules, work flow requirements, and have a back up if one machines goes down unexpectedly or is scheduled for maintenance.

The present multi-mode hammering machine has a drive mechanism structured to suite three different sheet metal forming jobs. The drive mechanisms is structured to easily switch the machine from one mode of operation to another. The power system is the same for both the rigid metal shaping mode and the flexible power hammer mode. The drive mechanism is the same for all three modes. The rigid movement of the ram tool is the same for both the rigid metal shaping and manual press modes. The stroke length and gap adjusting mechanisms are the same for all three modes. The machine combines specific components necessary for one, two or all three machine modes, while disengaging other components that are unnecessary or interfere with other machine modes. As a result, the machine will benefit metal forming shops by reducing machine and floor space overhead costs while meeting a wide array of customer demands and expectations.

Another advantage of the present multi-mode hammering machine is its ram drive assembly. This ram drive assembly includes a rigid lever drive assembly used in all three modes of operation. The rigid lever drive assembly interfaces with a reciprocating lever that is readily converted from a rigid metal shaping mode to a flexible power hammering mode. The lever includes both selectively engagable rigid plates and a selectively engagable spring. The conversion is readily achieved by simply inserting or removing a single conversion pin. The stroke length adjustment mechanisms is integrated into the rigid drive assembly. The gap adjustment mechanism is integrated into the reciprocating lever. The end result is a highly functional and commercially useful hammering machine that provides multiple functions so that machine and floor space costs are kept to a minimum.

A further advantage of the present multi-mode hammering machine is its independent stroke length and gap adjustment mechanisms. Both the stroke length and gap adjustment mechanisms operate independently of each other, and both function while the machine is in use. Both mechanisms operate when the rigid drive mechanisms and reciprocating lever are moving. This is particularly important for the power hammer mode because it allows the operator to adjust stroke length and gap to find the natural harmonic between the stroke length, gap and the material being shaped. The enhanced ram power or impact forces produced by setting the machine to achieve this natural harmonic further increases the versatility of the machine in that it can perform a wider variety of metal forming functions on a wider variety of sheet metal and workpiece thicknesses.

A still further advantage of the present multi-mode hammering machine is its rugged design. The ram drive assembly is specifically structured to handle the significant forces experienced by a hammering machine. The orientation of the components during moments of particularly high loading are aligned so that the components are not over stressed. Drive linkages have an in-line arrangement during moments of heightened or maximum compression that produce the impact between the ram and workpiece. As a result, the machine and its components do not experience excessive wear and tear, or require excessive service, and the machine has a long life.

A still further advantage of the present multi-mode hammering machine is its shape. The machine has a large open interior for easily accommodating a wide variety of workpieces. The ram drive assembly and stroke length and gap adjustment mechanisms extend around and not through this interior opening. Thus, the machine can handle a wide array of sheet metal products and jobs.

Other aspects and advantages of the invention will become apparent upon making reference to the specification, claims and drawings.

BRIEF DESCRIPTION OF THE DRAWINGS

FIG. 2A is a perspective view of the hammering machine 10 with a support plate 22 removed to show the ram drive assembly 60, the eccentric pivot pin 95 of the lever 90 and gap adjustment assembly 130, and the stroke length adjustment assembly 140 including its toggle mechanism 151.

FIG. 5A is a side plan view of the hammering machine 10 in its rigid metal shaping mode 190 with the conversion pin 105 locked in place, the drive crank 61 in its fully retracted position to angularly displace the control link 70 out of vertical and out of line with the piston rod 81 to draw the piston rod down, the toggle assembly 151 set for maximum stroke length with its control pin 141 at the bottom of curved slot 24, and the ram 41 in its maximum fully retracted position 48.

FIG. 5B is an enlarged partial view of FIG. 5A showing the ram 41 in its maximum retracted position 48 and its lower surface 42 located 0.550 inches above the top 46 of the gap to produce the maximum ram stroke length $SL_{Max}$ during operation in rigid metal shaping mode.

FIG. 5C is an enlarged partial view of FIG. 5A showing the path of travel 63 of the crank 61, with the crank shifted to the right to its fully retracted position 67.

FIG. 6A is a side plan view of the hammering machine 10 in its rigid metal shaping mode 190 with the drive crank 62 in its fully retracted position 67 to angularly displace the control link 70 and draw down the piston rod 81 as in FIG. 5A, but with the toggle assembly 151 set for minimum stroke length with its control pin 141 at the top of curved slot 24, and with the ram 41 in its minimum fully retracted position 49.

FIG. 6B is an enlarged portion of FIG. 6A showing the ram 41 in its minimum retracted position 49 and its lower surface 42 located 0.175 inches above the top 46 of the gap to produce the minimum ram stroke length $SL_{Min}$ during operation in rigid metal shaping mode.

FIG. 7A is a side plan view of the hammering machine 10 in its rigid metal shaping mode 190 with the conversion pin 105 locked in place with the toggle assembly 151 set for maximum stroke length with its control pin 141 at the bottom of curved slot 24 for maximum piston rod 81 retraction as in FIG. 5A, but with the drive crank 61 in its fully extended position 68 to vertically and linearly align the control link 70 with the piston rod 81 to push the piston rod up, and with the ram 41 in its fully extended position 46.

FIG. 7B is an enlarged portion of FIG. 7A showing the ram 41 in its fully extended position 46 with the lower surface 42 of the ram at the top of the gap during operation in the rigid metal shaping mode.

FIG. 8A is a side plan view of the hammering machine 10 in its rigid metal shaping mode 190 with the conversion pin 105 locked in place and the drive crank 61 in its fully extended position 68 to vertically and linearly align the control link 70 with piston rod 81 to push the piston rod up, and with the ram 41 in its fully extended position 46 as in FIG. 7A, but with the toggle assembly 151 and its control pin 141 set at the top of curved slot 24 for minimum stroke retraction as in FIG. 6A.

FIG. 8B is an enlarged portion of FIG. 8A showing the ram 41 in its fully extended position 46 with the lower surface 42 of the ram at the top of the gap during operation in the rigid metal shaping mode.

DESCRIPTION OF THE PREFERRED EMBODIMENTS

Figure 1:
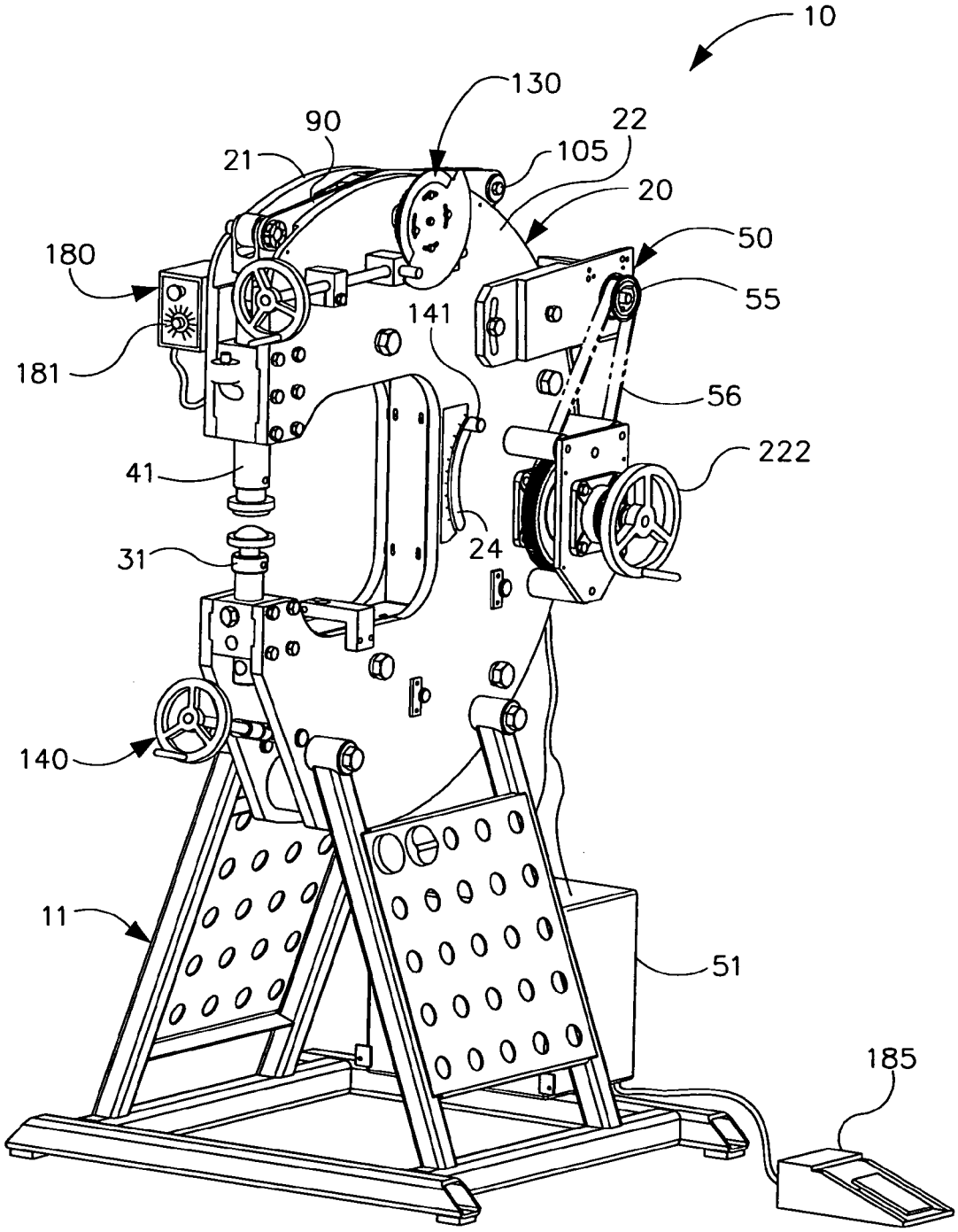
FIG. 1 is a perspective view of the inventive hammering machine 10 showing its base 11 and support structure 20, die 31, ram 41, power supply system 50 and exterior portions of its gap adjustment assembly 130.

While this invention is susceptible of embodiment in many different forms, the drawings show and the specification describes in detail a preferred embodiment of the invention. It should be understood that the drawings and specification are to be considered an exemplification of the principles of the invention. They are not intended to limit the broad aspects of the invention to the embodiment illustrated.

The present invention relates to a multi-mold hammering machine for shaping a workpiece 5 such as a sheet of metal. The multi-mode hammering machine is generally depicted as reference number 10 in FIG. 1. The machine 10 has a rigid meal shaping mode 190 where its ram has a rigid non-flexible stroke length. The machine 10 is readily switched from this mode to a flexible power hammer mode 200 by removing a conversion pin. In this mode, the ram has a flexible stroke length that varies with machine cycle speed. This power hammer mode utilizes a harmonic force multiplier to produce more significant impact forces by the ram on the workpiece. When the conversion pin is inserted and the motorized drive system is disengaged, the machine 10 can be used in a machine press mode 220. In this mode, the ram drive assembly is manually operated to lower the ram like a conventional machine press. While the machine 10 is particularly suited for shaping sheet metal 5 as shown in FIGS. 5A and 5B, it should be understood that the broad aspects of the invention are not limited to sheet metal.

The hammering machine 10 is mounted on a support frame 11 that includes a rectangular base 12 that rests on the floor of a building. The base 12 has a wide footprint to stabilize the machine and minimize shaking and vibration during operation. The frame 11 has front and rear A-frame supports 13 and 14. These supports 13 and 14 are rigidly secured to and extend upwardly from the base 12 to elevate a workpiece receiving area 15 of the machine 10 about four feet above the floor to facilitate ease of use and material handling during operation. The A-frames 13 and 14 are spaced apart and rigidly joined by two braces 16. While structurally strong, these braces 16 also have numerous openings or holes cut through them, so that the braces serve as tool racks to hold the various die and ram tools used during the operation of the machine 10. The machine 10 is about eight feet tall, has a front to back depth of about five feet, a side-to-side width of about three feet, and weight of about 1,600 pounds for added stability during operation.

The hammering machine 10 has a housing and support structure 20 for securing, supporting and protecting its internal components. This structure 20 includes first and second plates 21 and 22 that are spaced about 3½ inches apart to form an internal compartment that houses many of the working components of the machine 10. Each plate 21 and 22 is robustly designed and about one inch thick to withstand the significant cyclical loads produced by the machine 10. The plates 21 and 22 are joined together in spaced registry by a number of internal spacer posts 23. Each plate 21 and 22 has an accurate slot 24. Each plate also has a generally round perimeter and a large central opening 25 extending inwardly from the front or mouth 26 of the machine to form a generally C-shaped configuration. The C-shaped housing and support structure 20 defines the upper and lower jaws 27 and 28 located above and below its mouth 26 for receiving a workpiece 5. The mouth 26 generally forms the working area 15 of the machine 10. Plates 21 and 22 are generally symmetrical, and aligned so that their slots 24, openings 25, and outer perimeters are in substantial registry. Cover plates or shields 29 close the outer edges between the side plates 21 and 22 to prevent inadvertent contact with the moving internal components of the machine 10 and to prevent debris from entering the machine. These shields 29 are located along the outer perimeter of the support plates 21 and 22, as well as the internal perimeter forming the central opening 25.

Matched sets of workpiece forming tools 30 are mounted on a die 31 and a ram 41. Each tool set 30 includes a die tool 32 mounted on the die 31, and a ram tool 42 mounted on the ram 41. The die tool 32 has a contoured upper surface 32*a* designed to shape the workpiece 5 in a desired manner. The die tool 32 is rigidly fixed to one end of an elongated linear mounting shaft 33 by a removable pin or other conventional releasble tool mounting device. The mounting shaft 33 is vertical orientation and rigidly held by a mounting block 35 that is rigidly fixed between side plates 21 and 22 proximal the lower jaw 27. The shaft 33 and block 35 include cooperating height adjustment holes 37. The shaft has several space holes along its length. A locking pin rigidly secures the vertically oriented mounting shaft 33 to the mounting block 35. The locking pin fixes the height of the die 31 during the operation of the machine 10. The working opening 25 of the machine 10 includes a conventional workpiece support 37 to support the weight and help align the workpiece 5 between the die and ram tools 32 and 42 during the operation of the machine. The workpiece support 37 is rigidly fixed to the support structure 20, and can also be used as a visual guide or horizontal reference during the operation of the machine 10.

Figures 3A, 3B:
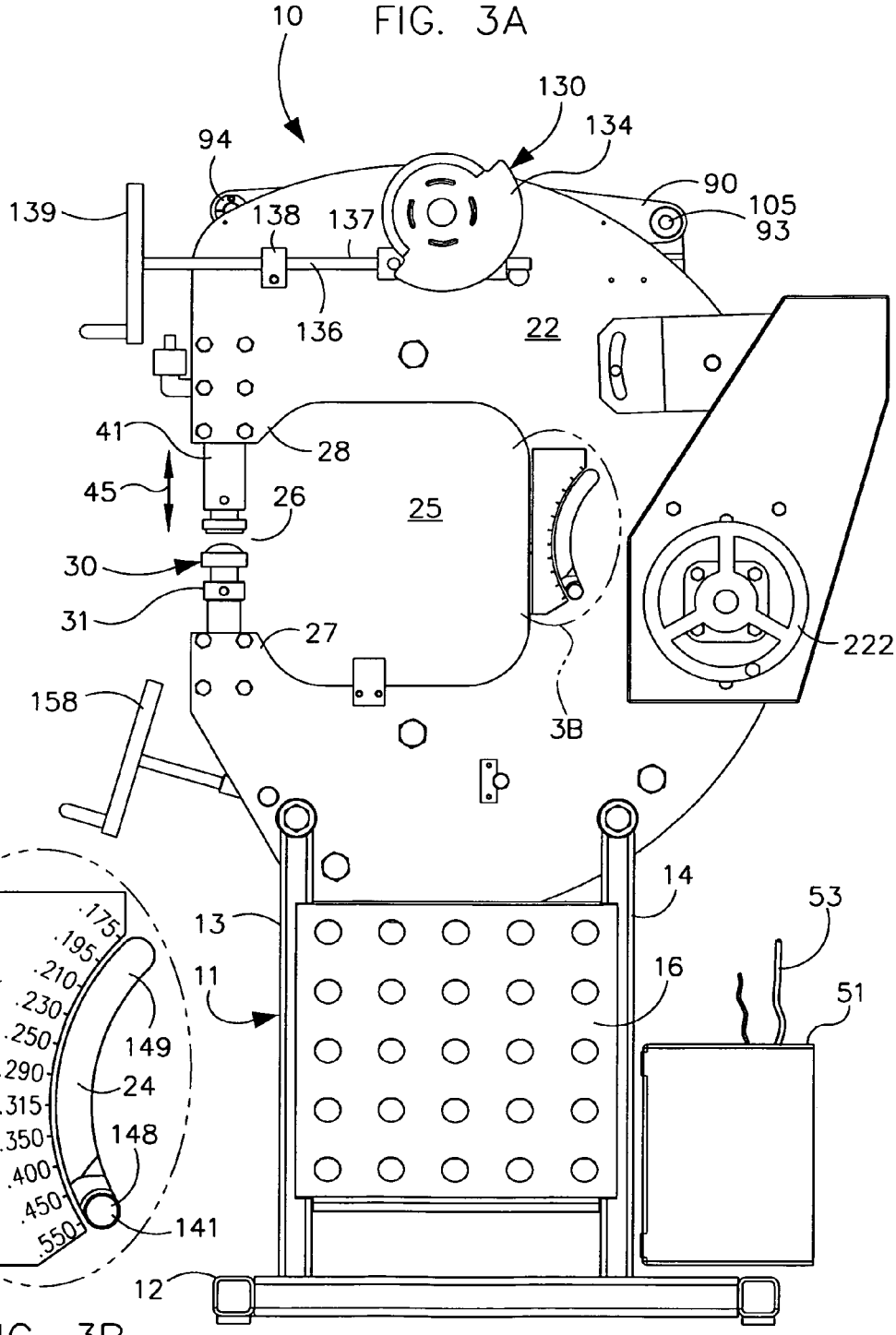
FIG. 3A is a side plan view of the hammering machine 10 showing its base 11 and support structure 20, die 31, ram 41, power supply system 50 and gap adjustment assembly 130, and including an enlarged view of its stroke length scale located along curved slot 24.
FIG. 3B is an enlarged partial view of FIG. 3A showing the stroke length adjustment scale adjacent the curved slot 24 with the toggle control pin 141 at its lowest or maximum stroke length position 48.

The ram tool 42 has a lower surface 42*a* that is flat or contoured to flushly mate or otherwise cooperate with its corresponding die tool surface 32*a*. Similar to the die tool 32, the ram tool 42 is rigidly fixed to one end of an elongated linear shaft 43 by a removable pin or other conventional releasble tool mounting device. The ram shaft 43 is vertically oriented and held by a linear bearing 44 that allows the ram 41, tool 42 and shaft 43 to move along a substantially vertical and linear path of travel 45 as shown in FIG. 3. The linear bearing 44 is rigidly fixed between side plates 21 and 22 proximal the upper jaw 28. An oil gauge is provided to ensure the bearing 44 is properly lubricated during operation.

The ram or hammer 41 moves cyclically between a bottom position 46 and an upper position 47 as shown in FIGS. 5A, 5B, 7A and 7B. The distance between the upper surface 32*a* of the die tool 32 and the lower surface 42*a* of the ram tool 42 when the ram 41 is at its bottom-most or bottom dead center position 46 constitutes the "gap" between the workpiece forming tools 30. The linear movement 45 of the ram tool 42 between its bottom dead center 46 and upper position 47 constitutes the stroke length SL of the ram 41. As discussed more fully below, the size or height of the gap can be adjusted during the operation of the machine 10. While the die 31 remains fixed during the operation, the bottom dead center position 46 of the ram 41 can be adjusted up or down to increase or decrease the size of the gap. Adjusting the size or height of the gap does not impact the stroke length SL of the ram 41. Adjusting the gap moves the entire stroke of the ram 41. Both the bottom 46 and upper 47 positions of the stroke move an equal amount when setting the gap. As is also discussed more fully below, the stroke length SL can be independently adjusted during the operation of the machine 10 by independently adjusting the upper position 47 between maximum 48 and minimum 49 retracted positions, as shown in FIGS. 5B and 6B.

The hammering machine 10 includes a power supply system 50 for driving ram 41. As shown in FIG. 1, an electric power box 51 is secured to the base 12 of the lower frame 11. The electric box 51 draws power via an electric cord plugged into a 20 amp, 230 volt electric outlet. The power box 51 includes a variable frequency drive (VFD) that converts the electricity before sending the electric power via cord 53 to an AC electric drive motor 54. The motor 54 is a standard 2 Hp, variable speed motor capable of rotating its output or drive shaft 55 at a rate of up to about 4,500 rpm. The drive shaft 54 is joined to a drive belt 56 that rotates a crank shaft 57. There is a 3 to 1 reduction via the belt 56, so the driven crank shaft 57 spins at a speed of up to about 1,500 rpm. The crank shaft 57 has a rotational centerline 58. The speed of the motor 54 and its drive shaft 55 determines the cycle speed or beats per minute (bpm) of the ram 41. The speed of the motor 54 is controlled by a control system, as discussed below.

The crank shaft 57 is held by a linear bearing and support frame secured to support plates 21 and 22. Both the motor drive shaft 55 and crank shaft 57 are free to rotate, but are otherwise fixed relative to the support structure 20 of the machine 10. The motor 54, drive shaft 55, belt 56 and crank shaft 57 are covered by a removable safety shroud during operation. Although the power supply system 50 is shown and described as a power system with an electric drive motor 54 drawing power from a conventional electrical outlet, it should be understood that the power supply system could be a hydraulic power supply system or other types of power supply system without departing from the broad aspects of the present hammering machine 10 invention.

The motor 54 and crank shaft 57 power a ram drive assembly 60 best shown in FIGS. 2A, 5A, 6A, 7A and 8A. The ram drive assembly 60 is held between support plates 21 and 22, and includes a rotating drive crank 61, toggle control link 70, lower rocker 76, upper piston link 81, reciprocating lever 90, linear conversion link 121 and ram shaft 43. The links, pins, rods, levers and shaft components forming the drive assembly 60 are robustly designed to withstand the sufficient loads generated by the hammering machine 10. The drive crank 61, rocker 76 and lever 90 are pivotally secured to these support plates 21 and 22. The control link 70, piston rod 81 and linear conversion link 121 are not directly secured to support plates 21 or 22. The ram is held by its linear bearing 44.

Figure 2B:
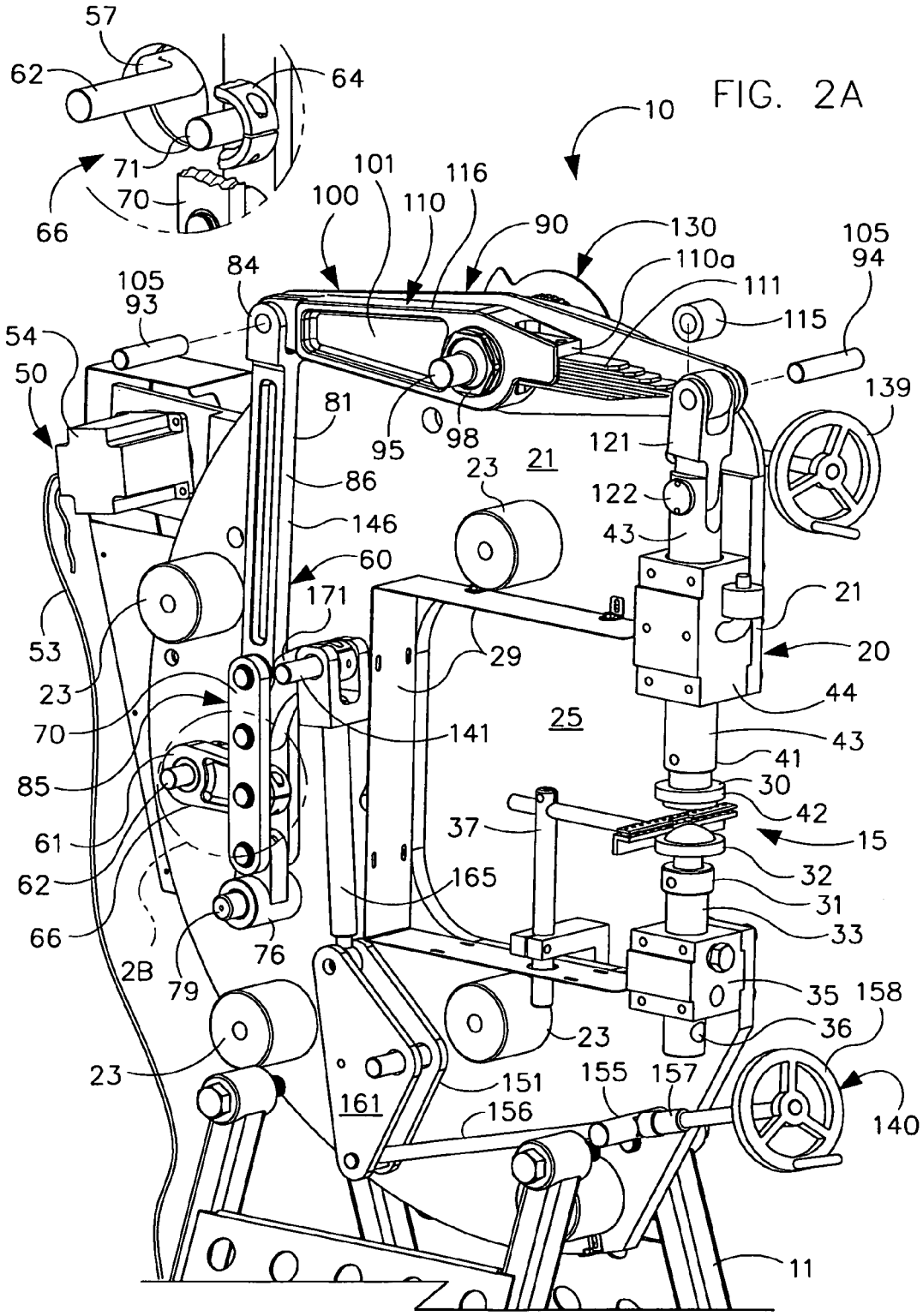
FIG. 2B is an enlarged cut away view of the crank 61 shown in FIG. 2A showing the drive shaft 57 and its offset drive crank 62.

The drive crank 61 is mounted to a crank 62 on drive shaft 57, as best shown in FIG. 2B. The crank 62 is offset from centerline 58 to revolve around the centerline in a circular path of travel 63, as shown in FIGS. 5C and 7C. Although the crank arm 64 revolves with the crank 62, the crank arm remains facing toward the front of the machine 10 and remains predominantly horizontal. The crank arm 64 has an outer end with a hole that receives a pin that joins it to the control link 70. The crank arm 64 has an internal weight reducing slot to reduce power loss. The drive crank 61 revolves around its circular path of travel 63, as the outer end of the crank arm 64 oscillates between a fully retracted position 67 (FIG. 5A or 6A) and a fully extended position 68 (FIGS. 2A, 7A and 8A). The outer end of the crank arm 64 oscillates back and forth in a generally curved or actuate path of travel toward and away from the front of the machine 10.

Proper positioning of the toggled control link 70 controls the stroke length SL of the ram 41. Control link 70 has four substantially evenly spaced pins 71-74 between its opposed ends, and an end pin to end pin length of about nine inches. Each pin is pivotally received in a hole formed in the link 70. A first pin 71 is inserted through a lower intermediate hole in the link 70, and pivotally connects the link 70 to the outer end 66 of the oscillating drive crank 61, as noted above. A second pin 72 is inserted through a hole near the lower end of the control link 70, and pivotally connects the link 70 to a lower rocker 76. The third pin 73 is inserted through an upper intermediate hole, and pivotally connects the control link 70 to a toggle arm 131 as discussed below. The fourth pin 74 is inserted through a hole near the upper end of the control link 70, and pivotally connects the link 70 to an upper piston rod or vertical extension link 81, as also discussed below.

The lower rocker 76 has an arm 77 with a hole in its outer end for receiving the second pin 72 of the control link 70. The lower rocker 76 is fixed to a pivot or rocker shaft 79. The shaft 79 is free to pivotally rotate, but is otherwise fixed to the support plates 21 and 22. The rocker arm 77 oscillates back and forth as the drive crank 62 and crank arm 64 revolve around path 63. The lower rocker 76 restricts the movement of the lower end of control link 70. The oscillating pivotal movement of the lower rocker 76 combines with the revolving movement of the drive crank 61 and toggle arm 131 to determine the position or orientation of the control link 70 and its path of movement.

The elongated piston rod 81 extends upwardly from the control link 70. The piston rod 81 has opposed ends 82 and 83 and a pin to pin length of about 18 inches. The lower end of 82 of the piston 81 has a hole for pivotally receiving link pin 74 of control link 70. The upper end 83 of the piston 81 has a hole for receiving a pin of reciprocating lever 90. The elongated vertical piston link 81 has a weight reducing slot along its length to improve the power and performance of the machine 10 and its ram drive assembly 60. The rod 81 remains substantially vertically oriented during all modes of operation of the machine 10. The piston rod 81 extends or elevates the ram drive assembly 60 above opening 25 so that the ram 41 can move up and down relative to the working area 15 of the machine 10. This length of the rod 81 is sufficient to permit the ram 41 to be raised to its elevated or retracted position 47, and stroked linearly downward toward the die 31 to its lower or bottom dead center position 46.

The drive crank 61, control link 70, lower rocker 76 and upper piston rod 81 form a lever drive assembly 85 that rigidly drives the reciprocating lever 90. The components 61, 70, 76 and 81 in the lever drive assembly 85 are sized and positioned to cooperatively extend and retract the piston rod 81 and lever 90 as the crank 61 rotates around its path of travel 63. The piston rod 81 returns its upper end 83 to the same upper most extended position 84 during each cycle of the drive crank 61, as shown in FIGS. 2A, 7A and 8A. The load bearing components or linkages 61, 70, 76 and 81 in the lever drive assembly 85 do not flex or bend. The cyclical movement of the lever drive assembly 85 rigidly drives the piston rod 81 in an up and down motion like the piston of a car engine, except that the stroke length SL of the piston rod 81 can be selectively varied. The lever drive assembly 85 is made of rigid metal components that extend and retract the piston rod 81 and one end of the lever 90 in a rigid, non-flexing movement. Although the stroke length SL of the piston rod 81 is selectively varied by varying its fully retracted position 87 between its maximum 88 and minimum 89 positions (FIGS. 5A and 6A, respectively), once the stroke length SL is set to a specific desired stroke length, the drive assembly 85 rigidly maintains that stroke length SL.

The lever drive assembly 85 cyclically moves between an in-line orientation with its load bearing linkages linearly aligned when in a single common fully extend position 86 (FIGS. 2A, 7A and 8A) and an angled orientation with its load bearing linkages angularly aligned when in a selectively variable fully retracted position 87. (FIG. 5A or 6A). The fully retracted position is selectively varied between its maximum 88 and minimum 89 angled positions. When the drive crank 61 is at its full retracted position 67 (FIG. 5C), the control link 70 has a generally angled orientation relative to the rocker 76 and piston rod 81. The control link 70 angles in one direction relative to the rocker 76, and the opposite direction relative to the piston 81. This angled orientation 87 draws down or retracts the piston rod 81 and lever 90. When the crank 62 and crank arm 64 are at their full extended position 66 (FIG. 7C), the control link 70 has a generally in-line or vertical position relative to the rocker 76 and piston link 81 as shown in FIGS. 2A, 7A and 8A. This in-line orientation 86 pushes up or extends the piston rod 81 and lever 90.

While the lever drive assembly 85 returns to its in-line orientation 86 when the crank 61 is at its fully extended position 66, the amount of the angle between its components 70, 76 and 81 when the crank 61 is at its retracted position 67 is selectively varied by the stroke length adjustment assembly, as discussed below. When the machine 10 is set to its maximum stroke length setting as in FIGS. 5A and 7A, the lever drive assembly 85 cyclically move between its full extend position 86 and a maximum full retract position 88. This stroke length setting provides the maximum stroke length $SL_{Max}$ of piston rod 81. In the preferred embodiment, the maximum stroke length $SL_{Max}$ of the lever drive assembly 85 and its piston rod 81 is about 0.550 inches. When the machine 10 is set to its minimum stroke length setting as in FIGS. 6A and 8A, the lever drive assembly 85 cyclically move between full extend position 86 and a minimum full retract position 89. This stroke length setting provides the minimum stroke length $SL_{Min}$ of piston rod 81. In the preferred embodiment, the minimum stroke length $SL_{Min}$ of the lever drive assembly 85 and its piston rod 81 is about 0.175 inches. Again, the piston rod 81 returns its upper end 83 to the same upper most extended position 84 (FIGS. 7A and 8A) during each cycle of the drive crank 61, no matter what the stroke length setting.

The reciprocating lever 90 is located at the top of the machine 10. The lever 90 is about 30 inches long to accommodate and span the central opening 25, is robustly designed and weighs about 55 pounds. The lever 90 has opposed ends 91 and 92. The rear end 91 is pivotally joined to the piston rod 81 by first pin 93. The front end 92 is pivotally joined to the linear conversion link 121 by a second pin 94. The lever 90 reciprocally pivots about a pivot pin 95 that serves as a fulcrum for the lever. This fulcrum pin 95 is preferably located at or near the center or middle of the lever. The outer ends of the pin 95 are collinear and pivotally held by bearing collars 96. Each collar 96 is rigidly bolted to one of the side plates 21 or 22. The collinear ends of the fulcrum pin 95 and the collars 96 form a centerline 97 of the lever 90. The pin 95 has an eccentric mid section 98 located between plates 21 and 22. The mid section 98 is offset to allow for adjustments to the gap between the die 31 and ram 41, as discussed below. The offset mid section 98 forms a rotational centerline or axis 99 for the pivotal movement of the lever 90.

The ram drive assembly 60 has both a rigid drive 100 and a flexible drive 110 as shown in FIG. 2. Both drives 100 and 110 are incorporated into the lever 90, and each spans the full length of the lever 90 from its rear end 91 to its front end 92. Both drives 100 and 110 are mounted on the midsection 98 of the fulcrum pin 95, and pivot about rotational axis 99 during operation. The drives 100 and 110 are not engaged at the same time. When one drive 100 or 110 is engaged, the other is simultaneously disengaged. The hammering extend position 86 and a minimum full retract position 89. This stroke length setting provides the minimum stroke length $SL_{Min}$ of piston rod 81. In the preferred embodiment, the minimum stroke length $SL_{Min}$ of the lever drive assembly 85 and its piston rod 81 is about 0.175 inches. Again, the piston rod 81 returns its upper terminal end 83 to the same upper most extended position 84 (FIGS. 7A and 8A) during each cycle of the drive crank 61, no matter what the stroke length setting.

The reciprocating lever 90 is located at the top of the machine 10. The lever 90 is about 30 inches long to accommodate and span the central opening 25, is robustly designed and weighs about 55 pounds. The lever 90 has opposed ends 91 and 92. The rear end 91 is pivotally joined to the piston rod 81 by first pin 93. The front end 92 is pivotally joined to the linear conversion link 121 by a second pin 94. The lever 90 reciprocally pivots about a pivot pin 95 that serves as a fulcrum for the lever. This fulcrum pin 95 is preferably located at or near the center or middle of the lever. The outer ends of the pin 95 are collinear and pivotally held by bearing collars 96. Each collar 96 is rigidly bolted to one of the side plates 21 or 22. The collinear ends of the fulcrum pin 95 and the collars 96 form a centerline 97 of the lever 90. The pin 95 has an eccentric mid section 98 located between plates 21 and 22. The mid section 98 is offset to allow for adjustments to the gap between the die 31 and ram 41, as discussed below. The offset mid section 98 forms a rotational centerline or axis 99 for the pivotal movement of the lever 90.

The ram drive assembly 60 has both a rigid drive 100 and a flexible drive 110 as shown in FIG. 2. Both drives 100 and 110 are incorporated into the lever 90, and each spans the full length of the lever 90 from its rear end 91 to its front end 92. Both drives 100 and 110 are mounted on the midsection 98 of the fulcrum pin 95, and pivot about rotational axis 99 during operation. The drives 100 and 110 are not engaged at the same time. When one drive 100 or 110 is engaged, the other is simultaneously disengaged. The hammering machine 10 is easily switched from one drive 100 or 110 to the other by selectively inserting or removing a conversion pin 105, as discussed below.

The rigid drive 100 is formed by a load bearing rigid assembly that rigidly joins the lever drive assembly 85 to the ram 41. The rigid assembly is formed by two spaced rigid, metal plates 101 that span the length of the lever 90. The plates 101 are located between and coplanar with each other and the support plates 21 and 22. Each plate weighs about 12 pounds. The rigid drive 100 is engaged when the rear 91 and front 92 ends of the plates 101 are pivotally pinned 93 and 94 to piston rod 81 and linear conversion link 121, respectively. The plates 101 rigidly join the piston rod 81 and conversion link 121 about a common pivot axis 99 so that each 81 and 121 moves in rigid unison with the other. The ends 91 and 92 move in an arced path about the rotational axis 99 of the pivot pin 95. Because the pivot pin 95 is preferably located at the center of the lever 90, the rigid drive 100 converts upward movement of the piston rod 81 into a substantially equal downward movement of the conversion link 121 and ram 41, and visa versa. When the rigid drive 100 is engaged, the stroke length SL of the piston rod 81 is substantially the same as the stroke length of the conversion link 121 and ram 41. For example, when the drive assembly 85 and piston rod 81 are set to a maximum stroke length $SL_{Max}$ of about 0.550 inches (FIGS. 5A and 5B), so is the ram 41. Similarly, when the drive assembly 85 and piston rod 81 are set to a minimum stroke length $SL_{Min}$ of about 0.175 inches (FIGS. 7A and 7B), so is the ram 41.

The flexible drive 110 is formed by a load bearing spring assembly 110*a* that flexibly joins the lever drive assembly 85 to the ram 41. The spring assembly includes a leaf spring 111 and a rigid torsion arm 116. The torsion arm 116 firmly grips, supports and provides leverage to flex or torque the leaf spring 111. The spring assembly 110*a* and its components 111 and 116 are located between or sandwiched by the plates 101 of the rigid drive 100. The leaf spring 111 is preferably located toward the front end 92 of the lever 90, and the rigid torsion arm 116 is preferably located toward the rear 91. In rigid mode, when the plates 101 are pinned at both ends 91 and 92 via pins 93 and 94, the leaf spring 111 and torsion arm 116 move in unison with the plates 101. The flexible drive 110 is effectively inoperative as the load is transmitted through the plates 101 of the lever 90. The flexible spring 111 and torsion arm 116 are rigidly connected to each other, but are not welded, bolted or otherwise directly or integrally fastened to the rigid plates 101. Selectively removing one of the outer pinned connections 93 or 94 disengages the rigid drive 100, and simultaneously engages the flexible drive 110.

The leaf spring 111 spans about half the length of the lever 90, and has a wide central end 112 and narrow outer end 113. The wide end 112 is formed by several individual spring plates, and is rigidly secured to torsion lever 116. The narrow end is formed by a single spring plate. The conventional leaf spring 111 flexes up and down, but does not generally flex from side-to-side or twist about its longitudinal axis. The leaf spring 111 has a rated stiffness or K value of about 1,000. The end 113 of the central plate of the leaf spring 111 forms a circular loop. The looped end 113 has a diameter of about two inches and is shaped to flushly and securely receive a first polyurethane sleeve 115.

The torsion arm 116 spans about half the length of the lever 90, and has central and outer ends 117 and 118. The central end 117 is secured to the midsection 98 of the pivot pin 95 and pivots with the leaf spring 111 about axis 99. The central end 117 has a pocket 117*a* to receive the spring 111 that extends about five inches out from axis 99 over the spring. The upper portion of the pocket 117*a* pushes down on the top of the spring 111 during the down stroke of the ram 41. The torsion arm 116 is rigid and does not flex. The arm 116 rigidly holds the wide central end 112 of the spring 111. The central end 112 of the spring 111 does not rotate relative to or slide in and out of the torsion arm 116. The outer end 118 of the support forms a two inch diameter hole that is shaped to flushly and securely receive a second metal sleeve 119. The upper end of the piston rod 81 is pivotally joined to the outer end 118 of the torsion arm 116 and can be pinned to the rigid plates 101 via pin 93.

The polyurethane sleeve 115 is slightly compressible and serves as a shock absorber. Both the polyurethane and metal sleeves 115 and 119 have a one inch diameter opening. The loop 113 of the spring 111 is pivotally joined to the linear conversion link 121 during all modes of operation. Similarly, the outer end 118 of the torsion arm 116 is pivotally joined to the piston rod 81 during all modes of operation. The ends of the sleeves 115 and 119 are flush with the sides of the outer ends 113 and 118, respectively. The outer end 118 of torsion arm 116 is pivotally joined to the rigid plates 101 by the pivot pin 93. The loop 113 of the spring 111 is pivotally joined to the rigid plates 101 by the pivot pin 94. The pins 93 and 94 are flushly received by the sleeves 115 and 119 and are free to rotate in ends 113 and 118, but otherwise remain fixed inside and directly joined to their respective end. The pins 93 and 94 are longer than the width of the support and spring ends 113 and 118. The pins 93 and 94 have a length of about four inches, and are longer than their respective sleeve 115 or 119. When inserted into their sleeve 115 or 119, the pins 93 and 94 extend through the aligned holes in the rigid plates 101. The ends of the pins 93 and 94 are flushly received by and extend through aligned holes in the plates 101.

The linear conversion link 121 transitions the pivoting motion of reciprocating lever 90 into the linear motion of ram 41. During rigid mode operation, the rigid lever plates 101 remain substantially horizontal, but pivot about ½° to 2° in either direction. During flex mode operation, the lever plates 101, spring 111 and torsion arm 116 pivot about ½° to 5° in either direction. The lower end of the conversion link 121 holds the pin 122 for pivotally joining the conversion link to the upper forked end of the ram shaft 43. The upper end of the conversion link 121 is pivotally joined to the outer loop end 113 of the spring and can be pinned to the rigid plates 101 via pin 94.

A conversion pin 105 is inserted in to one of the two ends 91 or 92 of the lever 90 to engage the rigid drive 100 and disengage the flexible drive 110. The conversion pin 105 can be either the pin 93 located at the rear end 91 of the lever 90, or the pin 94 located at the front end 92, as shown in FIG. 2A. The pin 105 is a bolt is threaded at one end, and secures or locks the pin in place by a pair of cooperating nut and washer. The pin 105 also serves as a shear pin to prevent overloading the ram drive assembly 60 during rigid mode operation. In the preferred embodiment, the conversion pin 105 is the pin 93 at the rear end 91 of the lever 90 as in FIGS. 5D and 7D. When the pin 94, 105 is removed to engage the flexible drive 110, the outer end 118 of the torsion arm 116 disengages from the rigid plates 101. The spring 111 flexes during both the up and down strokes of the ram and piston rod 81. During the up stroke of the piston rod 81 (down stroke of the ram 41), the spring pocket 117*a* of the torsion arm 116 press down into the top of the spring 111, and causes the spring and spring assembly to flex in what is believed to be a bowed manner.

Figure 5D:
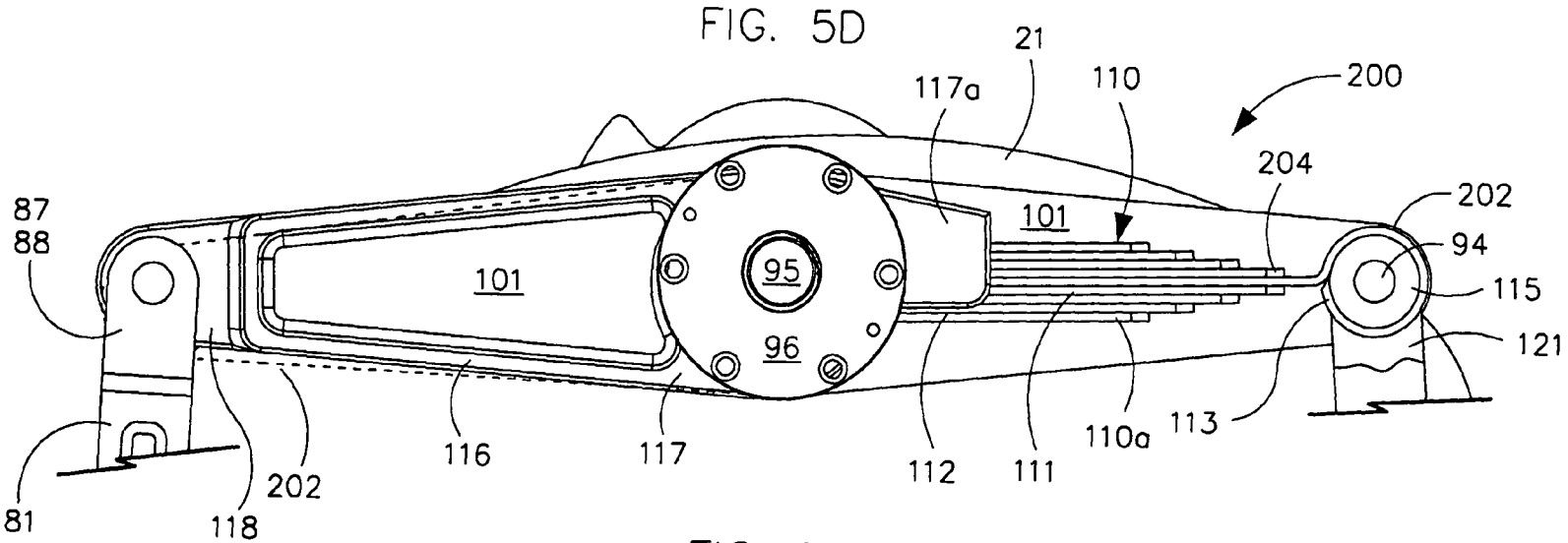
FIG. 5D is an enlarged portion of FIG. 5A showing the hammering machine in its power hammer mode 200 with the conversion pin 105 removed from the rear 91 of the lever 90 to engage the flex drive 110, and showing the plates 101 shifted down in phantom lines to further raise the conversion link 121 as the piston rod 81 reaches its lower most position 88 to increase the maximum fully retracted position 48' and stroke length SL' of ram 41.

In another embodiment, the conversion pin 105 is the pin 94 at the front end 92 of the lever 90 as in FIGS. 5DE and 7E. When the pin 94, 105 is removed to engage the flexible drive 110, the spring 111 extends from its secured wide end 112 in a cantilevered manner. The cantilevered extension of the spring 111 preferably starts at a location proximal the fulcrum pin 95, and continues to its terminal or flex end 113 formed by the central plate of the spring. The conversion pin 105 is inserted into sleeve 115 or 119 to place the machine 10 in a rigid reciprocating mode 190 and is removed from that sleeve to place the machine in a flexible power hammer mode 200, as discussed below. As the ram 41 is stroked up and down, the spring 111 and spring assembly flex in a cantilevered manner.

Figure 4:
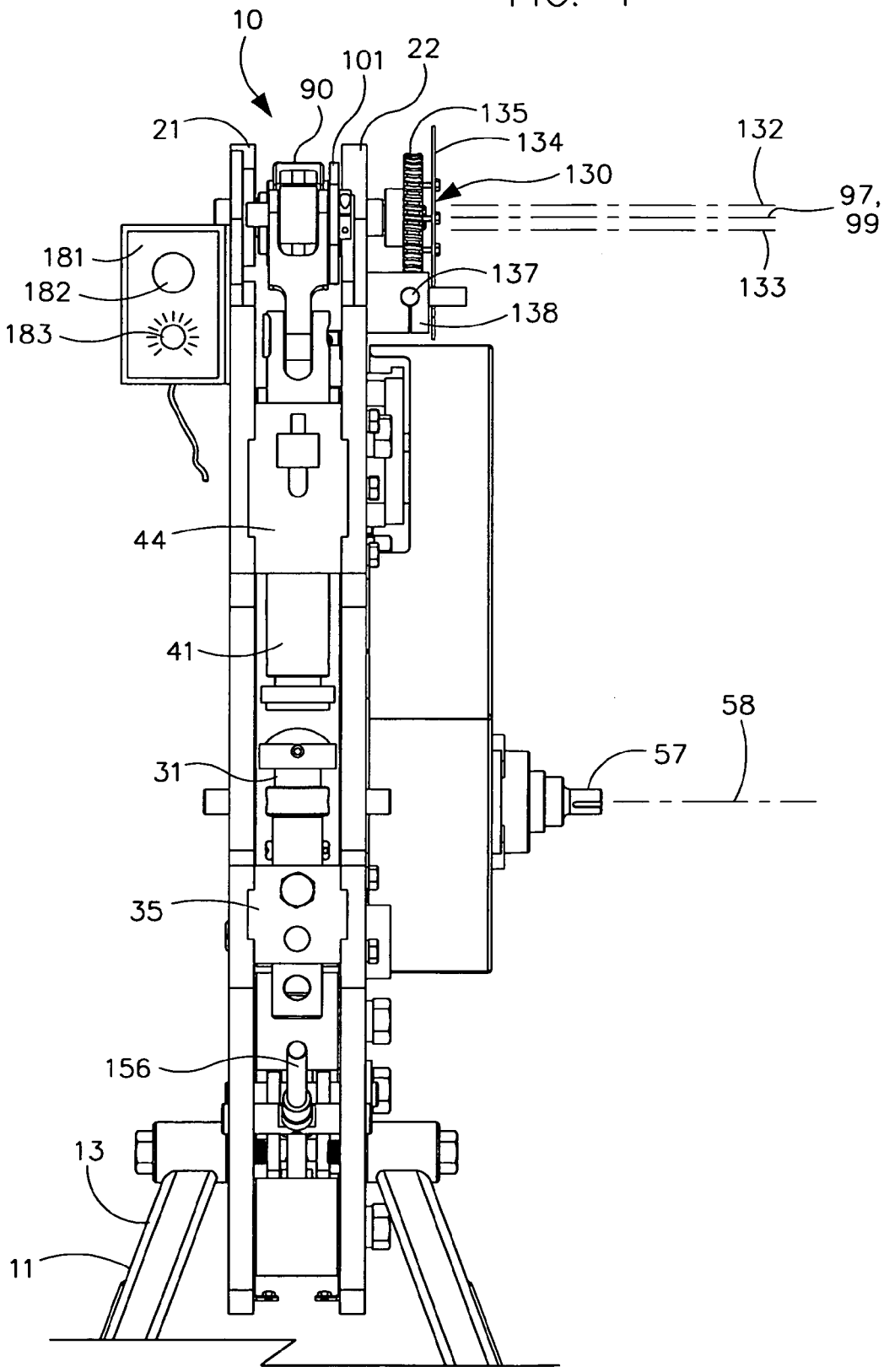
FIG. 4 is a front plan view of the hamming machine showing the rotational centerline and maximum upward and downward positions of the lever achieved by the gap adjustment mechanism, and showing the rotational centerline of the crank shaft of the ram drive assembly.

A gap adjustment assembly 130 is provided to set the "Gap" between the surface 32*a* of the die tool 32 and the surface 42*a* of the ram tool 42 when the ram 41 is at its lower most position 46 during rigid mode. The gap adjustment assembly 130 includes the eccentric pivot pin 95 of the lever 90. While the pin 95 is secured to the plates 21 and 22 at its outer ends via bearing collars 96, the rigid lever plates 101 and spring torsion arm 116 are secured to its eccentric mid-section 98. The rotational centerline 99 of the midsection 98 is offset about ½ inch from the centerline 97 of the fulcrum pin 95. As the pin 95 rotates about its centerline 97, the rotational or pivot axis 99 of the eccentric mid section 98 moves between a maximum and minimum gap positions 132 and 133, as shown in FIG. 4. The gap adjustment assembly 130 allows for continuous adjustment of the Gap, so the Gap can be set to any of an infinite number of positions between positions 132 and 133. The eccentric mid section 98 produces about a plus or minus one inch difference in height at the front end 92 of the lever 90 that is joined to the linear conversion link 121. The conversion link 121 and ram 41 move twice as much as the eccentricity of the pin 95 due to the fact that the rear end 91 of the lever 90 returns to the same point 84 when the lever drive assembly 85 is at its full extended position 86, and the fact that the pivot pin 95 is located at about the middle of the lever 90.

One end of the pivot pin 95 extends outwardly from plate 21 to rigidly join a rotation plate 134 and gear 135. A wheel assembly 136 with a threaded shaft 137 is used to rotate the gear 135 and eccentric pivot pin 95. The wheel assembly 136 includes a threaded mounting block 138 and turn wheel 139. By rotating turn wheel 139, an operator can rotate the eccentric pivot pin 95. Again, the rotation of the pivot pin 95 about its centerline 97 moves the axis 99 of its eccentric midsection 98 between maximum and minimum gap positions 132 and 133. This motion is used to raise and lower the ram 41 to set its bottom dead center position 46. The gap setting assembly 130 can be operated to set or adjust the gap when the machine is running, and operates independently of the stroke length adjustment assembly 140.

The stroke length adjustment assembly 140 sets the stroke length "SL" of the ram 41. The adjustment assembly 140 sets the variable lever drive retraction position 87 between the maximum 88 and minimum 89 lever drive retraction positions. The stroke length SL is selectively set by moving a control pin 141 received by the curved slot 24 of the support plates 21 and 22. The control pin 141 is positioned at the top 149 of the slot 24 for minimum rigid mode stroke length $SL_{Min}$ as in FIG. 1, and at the bottom 88 of the slot 24 for a maximum rigid mode stroke length $SL_{Max}$ as in FIG. 3A. The maximum rigid mode stroke lengths $SL_{Max}$ is preferably about 0.550 inches. The minimum rigid mode stroke length $SL_{Min}$ is preferably about 0.175 inches as shown on the scale best seen in FIG. 3B. It should be noted that the broad aspects of the invention are not limited to these particular maximum $SL_{Max}$ and minimum $SL_{Min}$ rigid mode stroke lengths. The stroke length adjustment assembly 140 allows for continuous adjustment of the stroke length SL, so the stroke length can be set to any of an infinite number of lengths between positions 88 and 89.

The adjustment assembly 140 selectively sets the variable ram retraction position 87 of the lever drive assembly 85, but has little or no effect on its full ram extension position 86. When the machine 10 is in its rigid metal shaping mode 190, the positions 86, 87, 88 and 89 of the lever drive assembly 85 directly correspond to the positions 46, 47, 48 and 49 of the ram 41, respectively. When the machine 10 is in its flexible hammer mode 200, the positions 86, 87, 88 and 89 of the lever drive assembly 85 are related to but do not necessarily directly correspond to the positions 46, 47, 48 and 49 of the ram 41 due to the flexing of spring 111 caused by the cyclical motion of the ram 41 and impact forces against the workpiece 5.

The stroke length adjustment assembly 140 uses a toggle mechanism 151 to set the lever drive retraction position 87, and thereby the rigid mode variable ram position 47. Toggle mechanism 151 is operable when the machine 10 is running and the ram 41 is cycling. The toggle mechanism 151 includes a turn wheel assembly 155 and a threaded positioning shaft 156 that is rotationally secured to a threaded mount 157 that is rigidly secured between 21 and 22 of the support structure 20. A turn wheel 158 is rotated to turn its threaded shaft 156. The threaded shaft 156 is joined to a triangular plate 161 via a pivot pin 162. Turning the wheel 158 draws pin 162 up or down the length of the shaft 156. The triangular plate 161 pivots about a pin 163 that is rigidly held by plates 21 and 22 of the support structure 20. Triangular plate 161 includes a third pin 164 that is pivotally joined to a slot arm 165.

Slot arm 165 is elongated with a first end secured to triangle 161 via pin 164, and a second end joined to the control pin 141. Control pin 141 is movingly received in the curved slots 24 of plates 21 and 22 so that the pin 141 will follow the path of the curved slot. Control pin 141 is pivotally joined to toggle arm 171 at one end. The other end of the toggle arm 171 is pivotally joined to the third pivot pin 73 of the control link 70. Rotating hand wheel 158 pivots triangle plate 161 to raise and lower slot arm 165 and control pin 141 along curved slot 24, to thereby position the third pivot pin 73 of the control link 70 at a desired location corresponding to the desired ram retraction position 87. Stroke length SL is set by setting the angular position of the control link 70 when the crank 61 is at its fully retracted position 67. The position of the control link 70 dictates the upper most position 47 and the stroke length (SL) of the ram during the rigid sheet metal shaping mode 190.

The hammering machine 10 includes a control system 180 that controls the speed or revolutions per minute (rpm) of the motor 54 and cycle speed or beats per minute (bpm) of the ram 41. The control system 180 includes a control panel 181 with an on/off switch 182 and a BPM limit knob 183, and a foot pedal 185. The panel 181 and pedal 185 are in electrical communication with the motor 54. The motor 54 and ram 41 speed are controlled or varied in two ways. First, the BPM limit switch 183 allows the operator to set the upper rotation speed of the motor 54 and corresponding cycle speed of the ram 41. While the AC motor 54 is capable of producing 2,000 bmp, the limit knob 183 can set the upper limit of the motor to a value at or less than 2,000 bpm. For example, the limit knob 185 can be set to 10 bpm, 100 bpm, 1,000 bpm or 2,000 bpm depending on the type of work being performed. Second, the foot pedal 185 allows the operator to control the motor 54 speed and ram 41 cycle speed between zero and the set upper level set by knob 183. Setting the limit switch 183 to a lower upper level (e.g., about 10 to 100 bpm) allows the operator greater control over the cycle speed of the ram 41 via the foot pedal 185. Setting the limit switch 183 to a higher upper level (e.g., about 1,000 to 2,000 bpm), allows the operator to rapidly shape a workpiece 5 by depressing the foot pedal 185 to attain a rapid ram speed.

As noted above, during the rigid reciprocating or sheet metal shaping mode 190, the ram 41 and linear conversion link 121 move rigidly in unison with the lever drive assembly 85, via the rigid drive plates 101. As the front end 92 of the lever 90 moves up and down a set predetermined distance, the ram 41 is rigidly stroked up and down substantially the same distance. This set distance is the desired stroke length SL of the ram 41. In the rigid reciprocal or rigid sheet metal shaping mode 190, the stroke length SL is set by the stroke length adjustment assembly 140. Stroke length SL is not a function of the cycle speed of the ram 41. Increasing or decreasing the cycle speed or bpm of the ram 41 does not effect the stroke length SL of the ram 41.

In the rigid reciprocating mode 190, conversion pin 105 is inserted into the sleeve 115 or 119. The insertion of this pin 105 pivotally and rigidly joins the piston rod 81 to the linear conversion link 121 and ram 41 via the rigid lever plates 101 to rigidly hold the stroke length of the ram, thereby bypassing the use of the leaf spring 111. The load generated by motor 54 is transmitted through the ram drive assembly 60 and cycles ram 41 through its linear up and down path of travel 45. Tight pin connections in this drive assembly 60 dictate that the position of the lower surface 42 of the ram 41, which directly correspond to the rotation of the drive crank 61 and the oscillation of the outer end of its arm 64.

The hammering machine 10 is readily converted from its rigid metal shaping mode 190 to a flexible power hammer mode 200 by removing the conversion pin 105. When the conversion pin 105 is removed, the flex drive 110 of lever 90 is activated and spring 111 is free to flex, which flexibly join the lever drive assembly 85 to the conversion link 121 and ram 41 to flexibly hold the stroke length of the ram, as discussed below. Load now passes through the flexible drive 110 and spring 111, and no longer passes through the rigid plates 101. As noted above, the conversion pin 105 is preferably the rear pin 93 of the lever 90, but can also be the front pin 94 or even both pins. When the rear pin 93 is the conversion pin 105, the change in momentum and cyclical acceleration of the ram 41, lever 90 and link 121 masses, apply a force to the spring 111 and cause it to flex a particular distance so as to store energy. When the front pin 94 or both pins 39 and 94 are removed, only the mass and acceleration of the ram 41 and link 121, apply force to the spring 111. The ram 41, lever 90 and conversion link 121 weigh about 17, 55 and 4 pounds, respectively, for a total of about 76 pounds. The amount the spring 111 flexes is a function of the cycle speed of the ram 41. The faster the speed of the ram drive assembly 60 and ram 41, the greater the cyclical acceleration of the components and the more the spring 111 will flex.

During flex mode 200, the speed of the motor 54 is preferably set so that the energy stored in the spring 111 releases as the ram 41 strikes the workpiece 5. The characteristics of the workpiece (e.g., elasticity, thickness, shape, etc.) as well as the stroke length and gap settings have an effect on when the spring releases. Controlling the machine cycle speed and stroke length and gap settings so that the spring releases energy on impact with the workpiece 5 increases the impact force of the ram 41 against the workpiece and the effective power of the machine 10. During the power hammer mode 200, the flexible drive 110 and leaf spring 111 also give the lever 90 a degree of flexibility that tends to increase the stroke length SL of the ram 41. This increase in stroke length can also increase the impact forces of the ram 41 against the workpiece 5 and the effective power of the machine 10.

Figure 5E:
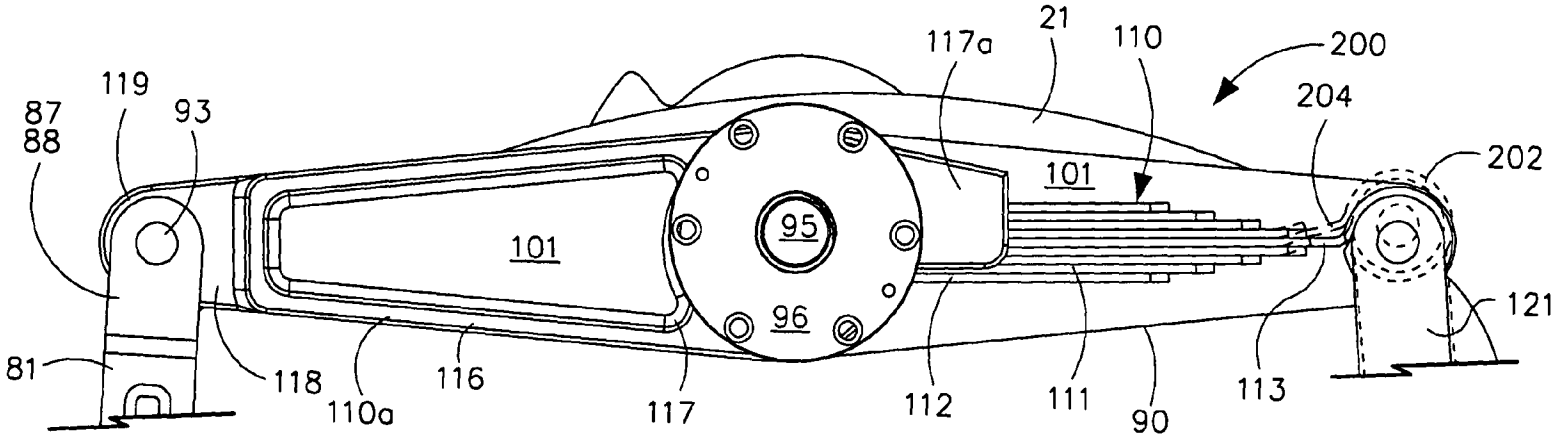
FIG. 5E is an enlarged portion of FIG. 5A showing the hammering machine in its power hammer mode 200 with the conversion pin 105 removed from the front 92 of the lever 90 to engage the flex drive 110, and showing the leaf spring 111 flexing up 204 in phantom lines to further raise the conversion link 121 as the lever 90 reaches its upper most position to increase the maximum fully retracted position 48' and stroke length SL' of ram 41.
Figure 5F:
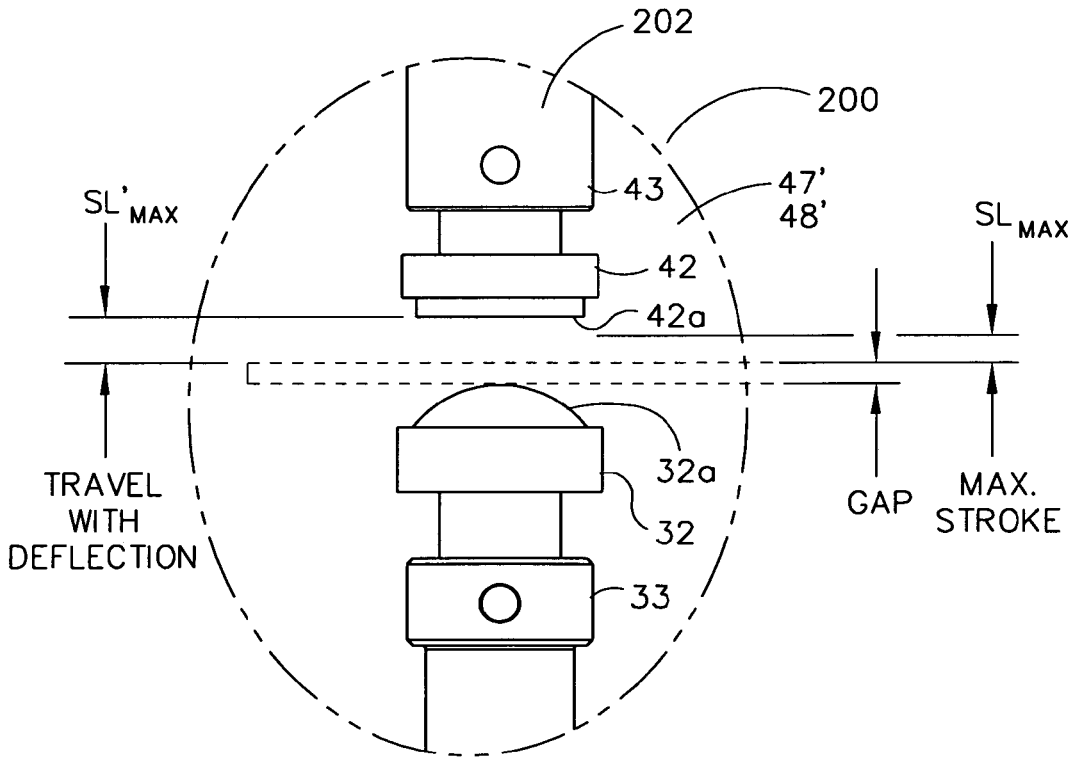
FIG. 5F is an enlarged portion of FIG. 5B showing the hammering machine in its power hammer mode 200 with the ram 41 moving upwardly to a position 48' beyond the upper most position 48 of the rigid metal shaping mode to increase the stroke length SL' of the ram.

Removing rear pin 93, 105 eliminates the rigid connection between the piston rod 81 and the rigid lever plates 101. The piston rod 81 remains pivotally joined to the rear end 118 of spring torsion arm 116. During operation, as the piston rod 81 moves down to its retracted position 87 as shown in FIG. 5D, the mass and upward momentum of the ram 41 and conversion link 121 and the mass and rotational momentum of the plates 101 cause the spring 111 to flex 204 which is seen by the downward shift 202 of the rear end of plates 101 relative to the piston rod 81 and torsion arm 116. While the lever drive assembly 85 and spring torsion arm 116 start to reverse their direction (begin moving upwardly) so as to begin pushing the ram down, the ram 41 and conversion link 121 continues moving upwardly. This flexes or loads the spring 111, which now stores releasable energy. The flexing of the spring 111 allows the upward stroke of the ram 41 to continue to a point 47' beyond the rigid mode retracted position 47 as shown in FIG. 5F. This spring flex also increases the stroke length SL of the ram 41. The polyurethane sleeve 115 at the front 113 of the lever 90 is believed to compress to allow the spring 111 to flex. As the cycle continues and the ram 41 moves along its down stroke toward the die 31, the spring 111 maintains its upward flex 204 and the rear end of the plates maintain their downward shifted 202 relative to the piston rod 81 and spring torsion arm 116 as the lever 90 is still driving or pushing the ram down.

Figure 7D:
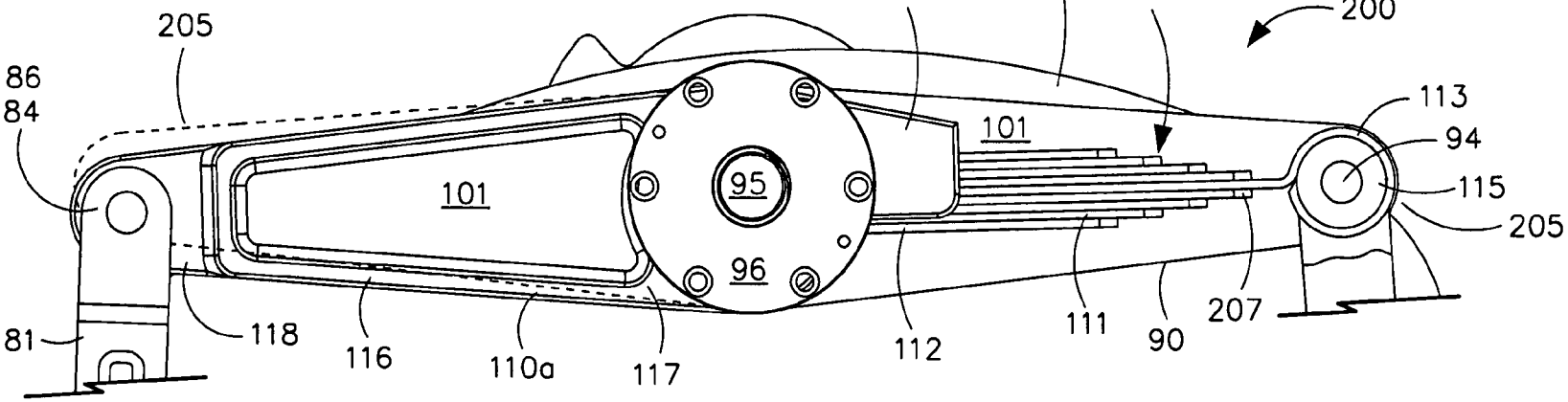
FIG. 7D is an enlarged portion of FIG. 7A showing the hammering machine in its power hammer mode 200 with the conversion pin 105 removed from the rear 91 of lever 90, and showing the plates 101 shifting up in phantom lines to further lower the conversion link 121 as of the piston rod 81 reaches its fully extended position 84.
Figure 7E:
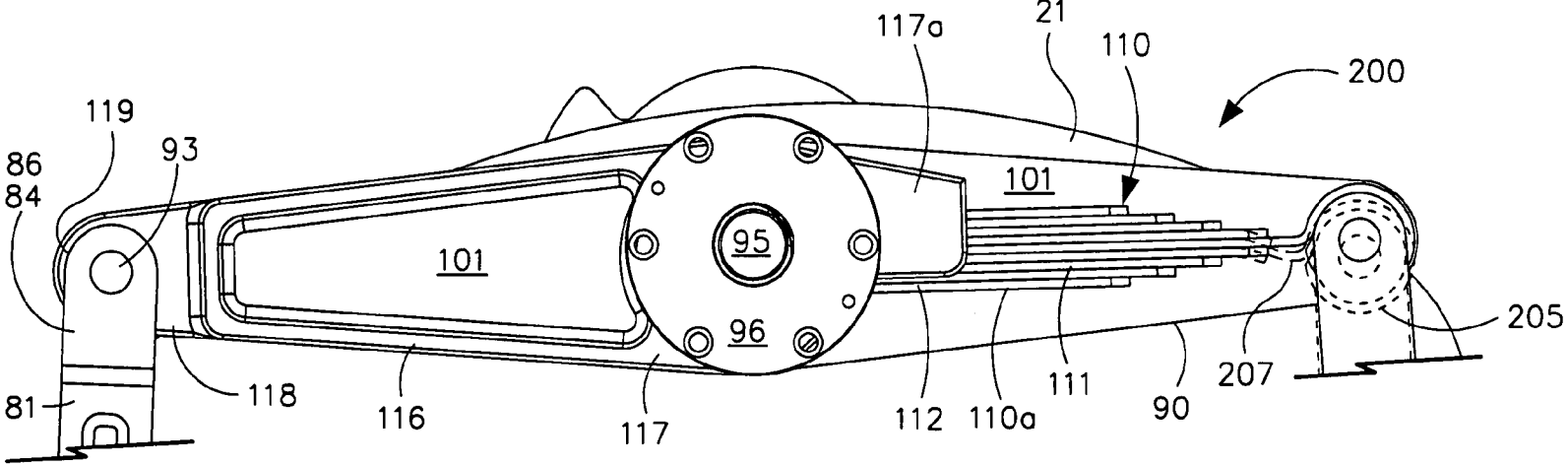
FIG. 7E is an enlarged portion of FIG. 7A showing the hammering machine in its power hammer mode 200 with the conversion pin 105 removed from the front 92 of lever 90, and showing the leaf spring 111 flexing down 207 in phantom lines to further lower the conversion link 121 as the fixed plates 101 of the lever 90 reach their bottom most position.
Figure 7F:
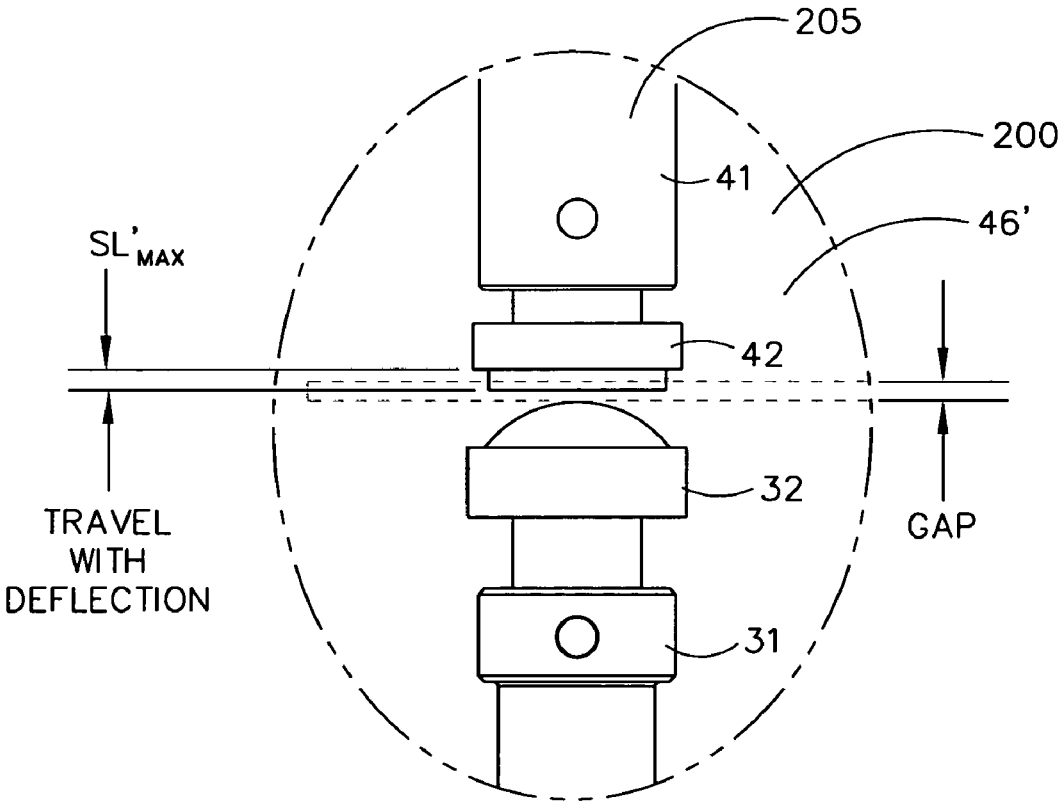
FIG. 7F is an enlarged portion of FIG. 7B showing the hammering machine in its power hammer mode 200 with the ram 41 moving downwardly to a position 46' beyond its lowest position 46 in the rigid metal shaping mode to and increase the stroke length SL' of ram and reduce the size of the gap.

As the piston rod 81 and spring support 111 reach the fully extended position 84 and ram 41 approaches its rigid mode fully extended position 46 as in FIG. 7D, the mass and momentum of the ram 41, plates 101 and conversion link 121 cause the spring 111 to transition and flex down 207, which is seen in the upward shift 205 of the rear end of the plates 101 relative to the piston rod 81 and torsion arm 116, which remain pinned together. The spring flex 207 allows the ram 41, front end of the plates 101 and the conversion link 121 to shift down or extended or lowered position 205. Again, the polyurethane sleeve 115 at the front 113 of the lever 90 is believed to compress to allow the spring 111 to flex. The transition and reverse spring flex 207 allows the ram 41 to continue moving to a point 46' beyond the bottom most position 46 of the rigid mode as shown in FIG. 7F. When no workpiece 5 is present, the ram 41 actually extends into the Gap of the rigid mode to further increase the stroke length SL' of the ram 41. This transition unloads the spring 111 and releases the stored energy in the spring 111.

When the workpiece 5 is placed on the die 31 and fills all or a part of the rigid mode Gap, the workpiece absorbs the impact of the ram 41 resulting from the energy released by the spring 111. The workpiece 5 stops the ram 41 from continuing into the gap all the way to its new flex mode bottom most position 46', and the ram bounces off the workpiece 5. The cyclical loading and unloading of the spring 111 begins anew each cycle as the piston rod 91 approaches its retracted position 87 and as in FIG. 5D. The power mode 200 can be used to create significantly greater hammering power against a workpiece 5 by adjusting the SL and bpm depending on the reaction between the ram and the workpiece 5 so that a harmonic multiplier is achieved on the down stroke of the ram 41.

Removing the front pin 94, 105 produces a similar power mode 200 operation. Removing the front pin 94, 105 eliminates the rigid connection between the linear conversion link 121 and the rigid lever plates 101. The loop end 113 of the spring 111 remains pivotally joined to the conversion link 121. As the ram 41 reaches its fully retracted position 47 and lever 90 and conversion link 121 reach their retracted or raised position 202 as shown in FIG. 5E, the upward momentum of the ram 41 and conversion link 121 cause the spring 111 to flex up 204 relative to the plates 101. As before, this upward spring flex 204 of the spring 111 throws the ram 41 or allows its stroke to continue to a point 47' beyond retracted position 47 as shown in FIG. 5F, which increases the stroke length SL of the ram. The upward spring flex continues during the down stroked of the ram 41 toward the die 31. The spring 111 is now pushing the ram 41 and conversion ling 121 down. As the ram 41 reaches its fully extended position 46 and lever 90 and conversion link 121 reach their extended or lowered position 205 as in FIG. 7E, the downward momentum of the ram 41 and conversion link 121 tend to cause the spring to flex down 207 relative to the front end 92 of plates 101. As before, this transition and reverse flexing of the spring 111 throws the ram 41 or allows its stroke to continue to a point 46' beyond the bottom most position 46 of the rigid mode, as in FIG. 7F.

The power mode 200 allows the operator to control the amount of shaping performed on the workpiece 5, such as via plannishing, stretching (thinning) or shrinking (thickening) the workpiece. For example, when the gap is set to about ¼ inch, the cycle speed is set to a higher speed (about 1,000 bpm or more) and before the workpiece 5 is inserted, the flexing of the lever 90 and spring 111 will allow the surface 42*a* of the ram tool 42 to engage or contact the surface 32*a* of the die tools 32 at the flexed bottom most position 46' of the ram. By leaving a portion of the workpiece 5 engaged between the ram 41 and the die 31 for a longer or shorter time or number of ram cycles, the operator can control the amount the workpiece is shaped. When the workpiece 5 is left between the ram 41 and die 31 for several ram beats, the workpiece will shrink or thin an amount approaching the flexed bottom most position 46' of the ram. (FIG. 7F). Conversely, when the workpiece 5 is only left between the ram 41 and die 31 for one or two ram beats, the shrinking of the workpiece will be less sever and may exceed the thickness of the gap setting. The amount of shaping performed by each ram beat depends on the properties of the workpiece 5 such as its hardness and toughness.

During the power mode 200, the gap is typically set so that the downward movement or stroke of the ram 41 is stopped by its impact against the workpiece 5. The workpiece 5 is held against the surface of the die 31. This impact force causes the workpiece 5 to compress and the ram 41 to bounce up off the workpiece 5. As noted above, the amount of the bounce is believed to be a function of the gap, stroke length and material properties of the workpiece 5, such as its elasticity and compressibility, as well as the surface area of the workpiece being compressed between the die 31 and ram 41. The bouncing effect can be harmonically matched with the cycle speed or bpm of the ram 41 to further increaser the upward flexing 204 of the spring 111 in its raised position 202. When cycle speed and material properties are harmonically matched, the energy stored in the spring 111 via its upward flexing 204 is released during the down stroke at the moment of impact of the ram 41 against the workpiece 5 to increase the impact force between them. This increase in impact force or force multiplier effectively increases the power of the machine 10.

The hammering machine 10 includes a manual ram positioning hand wheel 222. The hand wheel 222 does not grip or rotate with the crank shaft 57 when the shaft is driven by motor 54 for safety reasons. The hand wheel 222 engages and grips crank shaft 57. The hand wheel 222 is used for a variety of purposes, such as to raise the ram 41 to its upper most position 47 to allow the machine operator to change tools 32 or 42, or to disengage the ram 41 from the workpiece 5 to remove the workpiece. The hand wheel 222 engages to the crank shaft 57 to achieve a one-to-one turn ration. One complete revolution of the hand wheel 222 turns the crank shaft 57 one complete revolution.

The ram positioning hand wheel 222 also allows the hammering machine 10 to be used as a press. The machine 10 is set to its rigid reciprocating or sheet metal shaping mode 190 by inserting the conversion pin 105. The machine operator then sets the gap to the desired size or height. The height of the gap is less than the thickness of a selected workpiece 5. The gap size determines the amount of compression of the ram 41 into the workpiece 5. The hand wheel is rotated to raise the ram 41 to its upper most position 47. Then a one half or 180° turn of the hand wheel 222 lowers the ram 41 to its bottom most position 46 to compress the workpiece 5 in a manner similar to a conventional machine press. The wheel 222 is then further rotated a second half turn or 180° to raise the ram 41 up and away from the workpiece 5.

An optional DC servo motor can replace of the AC motor 54. The DC servo motor allows the motor powered reciprocating mode 190 to deliver a single hit or blow to the workpiece 5. The BPM limit switch 185 can also be set to a relatively low value such as below 30 bpm or less to use the machine 10 as a press.

While the invention has been described with reference to a preferred embodiment, it will be understood by those skilled in the art that various changes may be made and equivalents may be substituted without departing from the broader aspects of the invention.

I claim:

1. A multi-mode hammering apparatus for shaping a workpiece such as sheet metal, said multi-mode hammering apparatus comprising:

a die secured to a support structure, said die and support structure being adapted to receive the workpiece;

a ram cyclically movable along a path of travel toward and away from said die between fully extended and fully retracted ram positions that define a stroke length of said ram;

a ram drive assembly including a motor, lever drive assembly and lever, said motor cyclically driving said lever drive assembly at a selectively variable rate of speed between fully extended and fully retracted drive positions, said lever being pivotable about a pivot axis, joined to said lever drive assembly on a first side of said pivot axis and joined to said ram on a second side of said pivot axis, said lever further including a rigid drive and a flexible drive, said rigid drive having at least one load bearing rigid member rigidly joining said lever drive assembly to said ram, and said flexible drive having at least one load bearing flexible member flexibly joining said lever drive assembly to said ram, said ram drive assembly cyclically moving said ram between said fully extended and a fully retracted ram positions; and, wherein said ram drive assembly operates in a rigid reciprocating mode when said rigid drive is engaged and a flexible power hammer mode when said flexible drive is engaged, said stroke length of said ram being rigidly held by said ram drive assembly when in said rigid reciprocating mode, and said stroke length of said ram being flexibly held by said ram drive assembly and increasing with said speed of said motor when in said power hammer mode.

2. The multi-mode hammering apparatus of claim 1, and wherein said lever has first and second ends and a predetermined length, and said ram drive assembly includes a linear conversion link pivotally joined to said ram;

said at least one load bearing rigid member includes a plate with first and second ends and extends said length of said lever, said first end of said plate being pivotally joined to said lever drive assembly and said second end of said plate being pivotally joined to said linear conversion link; and, said at least one load bearing flexible member includes a spring assembly with first and second ends and extends said length of said lever, said first end of said spring assembly being pivotally joined to said lever drive assembly and said second end of said spring assembly being pivotally joined to a linear conversion link.

3. The multi-mode hammering apparatus of claim 2, and wherein said spring assembly includes a leaf spring and a rigid torsion arm that rigidly holds one end of said leaf spring, said leaf spring extending from about said center of said lever to said second end of said lever, and said torsion arm extending from said first end of said lever to about said center of said lever.

4. The multi-mode hammering apparatus of claim 3, and wherein one of said first and second ends of said lever includes a selectively removable conversion pin, said conversion pin pivotally pinning one of either said first and second ends of said plate to one of either said lever drive assembly and said conversion link, and wherein said flex drive is engaged and said rigid drive is simultaneously disengaged by selectively removing said conversion pin, and said flex drive is disengaged and said rigid drive is simultaneously engaged by selectively inserting said conversion pin.

5. The multi-mode hammering apparatus of claim 4, and wherein said first end of said lever includes said conversion pin, and said conversion pin pivotally pins said first end of said plate to said lever drive assembly.

6. The multi-mode hammering apparatus of claim 4, and wherein said second end of said lever includes said conversion pin, said conversion pin pivotally pins said second end of said plate to said linear conversion link.

7. The multi-mode hammering apparatus of claim 2, and wherein said pivot axis is substantially centrally located on said lever, and said plate and spring assembly each pivot about said centrally located pivot axis.

8. The multi-mode hammering apparatus of claim 1, and further including a stroke length adjustment assembly joined to said lever drive assembly, said stroke length adjustment assembly being operable to selectively set said fully retracted drive position within a range of positions between maximum and minimum fully retracted drive positions, and wherein said stroke length adjustment assembly is operable to correspondingly selectively set said fully retracted ram position within a continuous range of positions between maximum and minimum fully retracted ram positions to selectively adjust said stroke length of said ram.

9. The multi-mode hammering apparatus of claim 8, and wherein said stroke length adjustment assembly includes a toggle mechanism with a control pin selectively movable in a continuous manner between maximum and minimum fully retracted adjustment positions to selectively set said fully retracted drive position within a continuous range of positions between maximum and minimum fully retracted drive positions.

10. The multi-mode hammering apparatus of claim 9, and wherein said lever drive assembly has an in-line orientation when in said fully extended position and an angled orientation when in said fully retracted position.

11. The multi-mode hammering apparatus of claim 10, and wherein said lever drive assembly includes a drive crank, rocker arm, control link and piston rod, said control link is pinned at spaced locations to each of said drive crank, rocker arm and piston rod, and said rocker arm, control link and piston rod are in said in-line orientation when in said fully extended position, and said rocker arm, control link and piston rod are in said angled orientation when in said fully retracted position.

12. The multi-mode hammering apparatus of claim 11, and wherein said control link is located between said rocker arm and piston rod, and said stroke length adjustment assembly is pivotally joined to said control link.

13. The multi-mode hammering apparatus of claim 9, and wherein said support structure includes spaced rigid C-shaped support plates that form a large central opening and mouth with upper and lower jaws adapted to receive the workpiece, said ram drive assembly and stroke length adjustment assembly being held between said C-shaped support plates and extending around said central opening.

14. The multi-mode hammering apparatus of claim 13, and wherein said range of positions of said stroke length adjustment assembly is defined by a slot in said rigid support plates, a first end of said slot defining said maximum fully retracted adjustment position and a second end of said slot defining said minimum fully retracted adjustment position, and said control pin travels in said slot, said control pin being selectively movable in said slot between its said first and second ends by said toggle mechanism.

15. The multi-mode hammering apparatus of claim 8, and further including a gap adjustment assembly connected to said lever, said gap adjustment assembly selectively moving said pivot axis of said lever within a range of positions between maximum and minimum pivot positions to selectively set a gap between said die and ram when said ram is in its said fully extended position.

16. The multi-mode hammering apparatus of claim 15, and wherein said gap adjustment mechanism includes an eccentric pivot pin with collinear ends that define a central axis and an eccentric midsection that defines said pivot axis, said pivot pin being rotatably mounted by its said collinear ends to a support structure, and a gear, rod and hand wheel assembly for selectively rotating said eccentric pivot pin about its said central axis to selectively move said eccentric midsection and pivot axis within a continuous range of positions between said maximum and minimum pivot positions.

17. The multi-mode hammering apparatus of claim 15, and wherein said piston rod has an upper terminal end joined to said lever and said upper terminal end returns to an upper most position when said lever drive assembly is in it said fully extended position, and said upper most position is substantially unaffected by adjustments made by said gap and stroke length adjustment assemblies.

18. The multi-mode hammering apparatus of claim 17, and wherein said stroke length adjustment assembly and gap adjustment assembly are independently operable and operable while said ram drive assembly cyclically moves said ram to maximize impact force of said ram against the workpiece during power hammer mode.

19. The multi-mode hammering apparatus of claim 1, and the wherein said motor is a variable speed motor operable at a selectively variable rate of speed, and said apparatus includes an electric control system with a limit knob and foot pedal for controlling said rate of speed of said motor and said cycle speed of said ram drive assembly and ram.

20. The multi-mode hammering apparatus of claim 1, and wherein said die is selectively movable between higher and lower positions, but remains fixed during operation.

21. The multi-mode hammering apparatus of claim 1, and wherein the ram drive assembly includes a hand wheel, said hand wheel being rotatable to manually drive said ram drive assembly in a machine press mode.

22. A multi-mode hammering apparatus for shaping a workpiece such as sheet metal, said multi-mode hammering apparatus comprising:

a die secured to a support structure, said die being adapted to receive the workpiece;

a ram cyclically movable along a path of travel toward and away from said die between fully extended and fully retracted ram positions that define a stroke length of said ram;

a ram drive assembly including a motor, a lever drive assembly and a lever, said ram drive assembly being held by said support structure, said motor cyclically driving said lever drive assembly, said lever drive assembly having a control link and said lever having a pivot axis, said lever drive assembly being cyclically movable between a fully extended drive position and a filly retracted drive position, said control link being in-line with other links in said lever drive assembly when in said filly extended drive position and being angled relative to those said other links when in said fully retracted drive position, said lever being pivotable about said pivot axis, joined to said lever drive assembly on one side of said pivot axis and joined to said ram on said second side of said pivot axis, said lever further including a rigid drive and a flexible drive, said rigid drive having at least one load bearing rigid member to rigidly join said lever drive assembly to said ram, and said flexible drive having at least one load bearing flexible member to flexibly join said lever drive assembly to said ram;

a gap adjustment assembly connected to said lever, said gap adjustment assembly selectively moving said pivot axis of said lever to a position between maximum and minimum pivot positions to selectively set a gap between said die and ram when said ram drive assembly moves said ram to a said fully extended position;

a stroke length adjustment assembly joined to said lever drive assembly, said stroke length adjustment assembly being operable to selectively set said fully retracted drive position within a continuous range of positions between maximum and minimum fully retracted drive positions, and wherein said stroke length adjustment assembly is operable to correspondingly selectively set said fully retracted ram position within a continuous range of positions between maximum and minimum fully retracted ram positions to selectively adjust said stroke length of said ram; and, wherein said multi-mode hammering apparatus operates in a rigid metal shaping mode when said rigid drive is engaged and a flexible hammer mode when said flexible drive is engaged, said gap and stroke length being rigidly maintained by said ram drive assembly when in said rigid metal shaping mode, and said gap and stroke length being flexibly maintained when in said flexible hammer mode, said stroke length adjustment assembly and gap adjustment assembly being independently operable while said ram drive assembly cyclically moves said ram.

* * * * *